US006142470A

United States Patent [19]

Noda et al.

[11] Patent Number: 6,142,470

[45] Date of Patent: Nov. 7, 2000

[54] SORTER WITH BIN MOVEMENT CONTROL SYSTEM

[75] Inventors: Takashi Noda, Okazaki; Akira Ohhata, Toyohashi; Yoshikazu Takesada, Toyokawa, all of Japan

[73] Assignee: Minolta Co., Ltd., Osaka, Japan

[21] Appl. No.: 09/056,809

[22] Filed: Apr. 8, 1998

[30] Foreign Application Priority Data

Apr. 11, 1997 [JP] Japan ..... 9-094246

[51] Int. Cl.[7] ..... B65H 39/11

[52] U.S. Cl. ..... 271/292; 271/288; 271/176; 270/58.07; 270/58.08

[58] Field of Search ..... 271/288, 292, 271/294, 176; 270/58.07, 58.08

[56] References Cited

U.S. PATENT DOCUMENTS

| | | | |
|---|---|---|---|
| 3,879,032 | 4/1975 | Shirahase | 271/64 |
| 4,603,850 | 8/1986 | Horiuchi | 271/288 |
| 5,186,454 | 2/1993 | Kitahara | 271/288 |
| 5,345,303 | 9/1994 | Hiroi et al. | 271/292 X |
| 5,556,251 | 9/1996 | Hiroi et al. | 271/292 X |
| 5,639,077 | 6/1997 | Hirano et al. | 270/58.12 |
| 5,742,890 | 4/1998 | Kato et al. | 271/292 X |

FOREIGN PATENT DOCUMENTS

| | | |
|---|---|---|
| 59-223654 | 12/1984 | Japan . |
| 61-57264 | 5/1986 | Japan . |
| 401288566A | 11/1989 | Japan . |
| 4-23885 | 6/1992 | Japan . |
| 404246063A | 9/1992 | Japan . |
| 405139609A | 6/1993 | Japan . |
| 409083722A | 3/1997 | Japan . |

*Primary Examiner*—Christopher P. Ellis
*Assistant Examiner*—Patrick Mackey
*Attorney, Agent, or Firm*—Morrison & Foerster, LLP

[57] ABSTRACT

An image forming system which is comprised of a copying machine, and a sorter which has a bin assembly having a plurality of bins. In the sorter, the bin assembly is movable up and down pitch by pitch to store sheets on each bin, and stapled the stored sheets if necessary. A bin to store a first sheet and a first moving direction of the bin assembly are set in such a way that the bin assembly is stopped upward when the last process to sheets is finished.

25 Claims, 35 Drawing Sheets

FIG. 10a NORMAL OPERATION
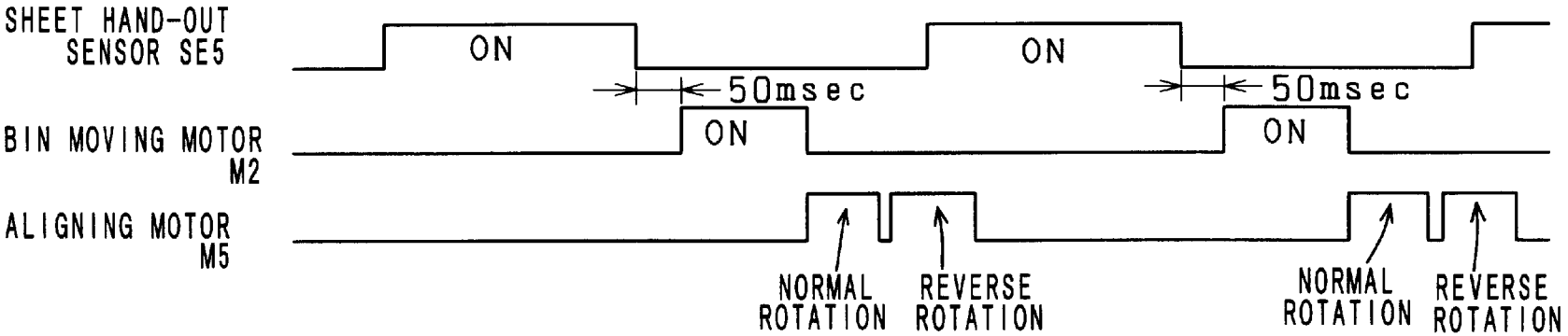
FIG. 10b SORTING SHEETS SUCCESIVELY TO BINS
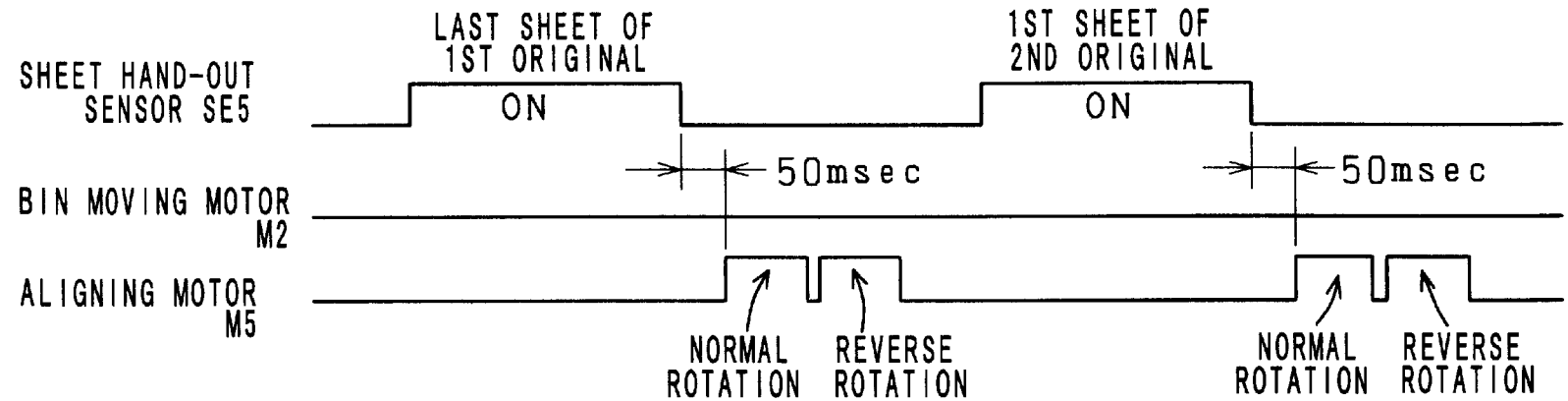

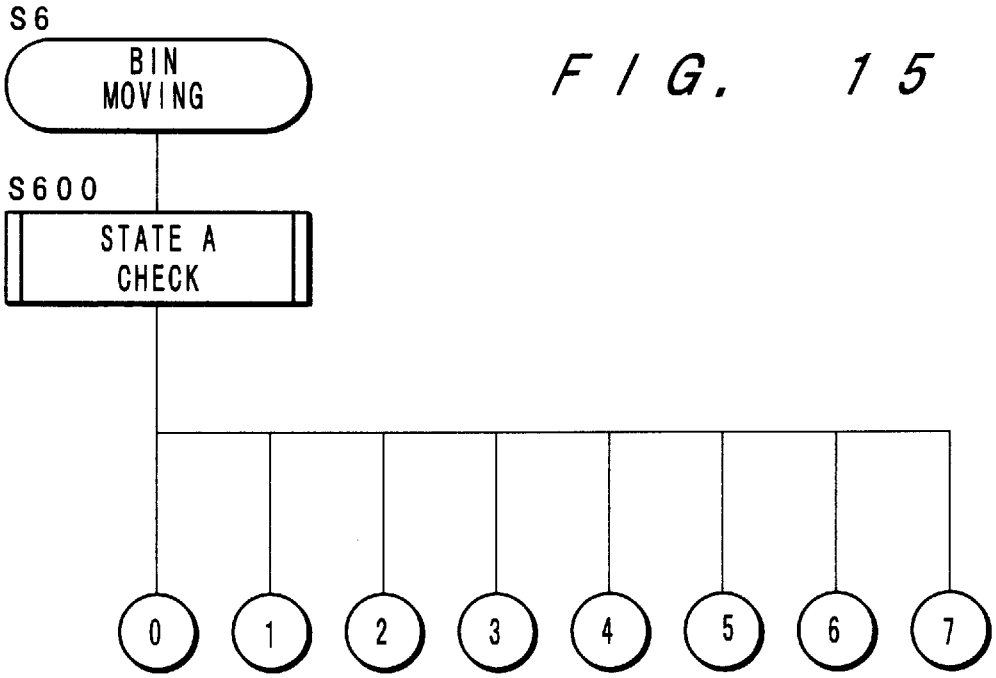
FIG. 15
FIG. 16
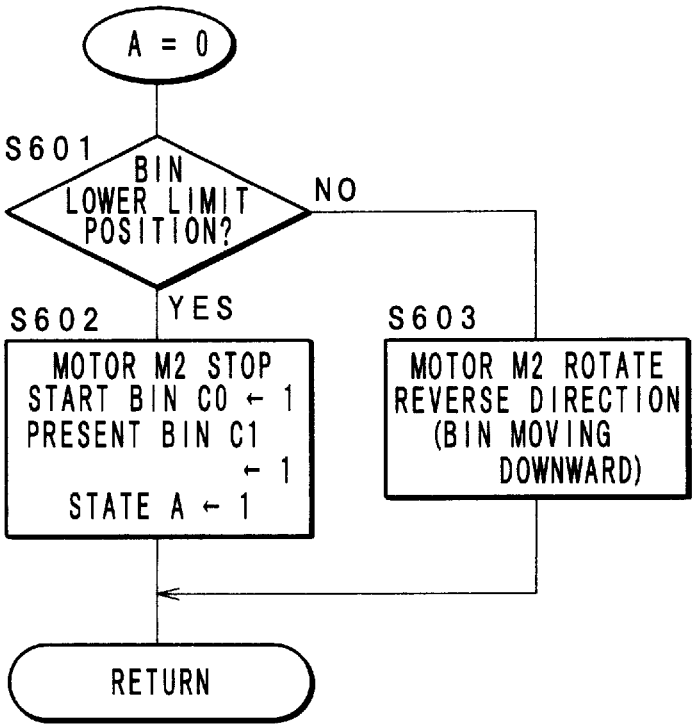

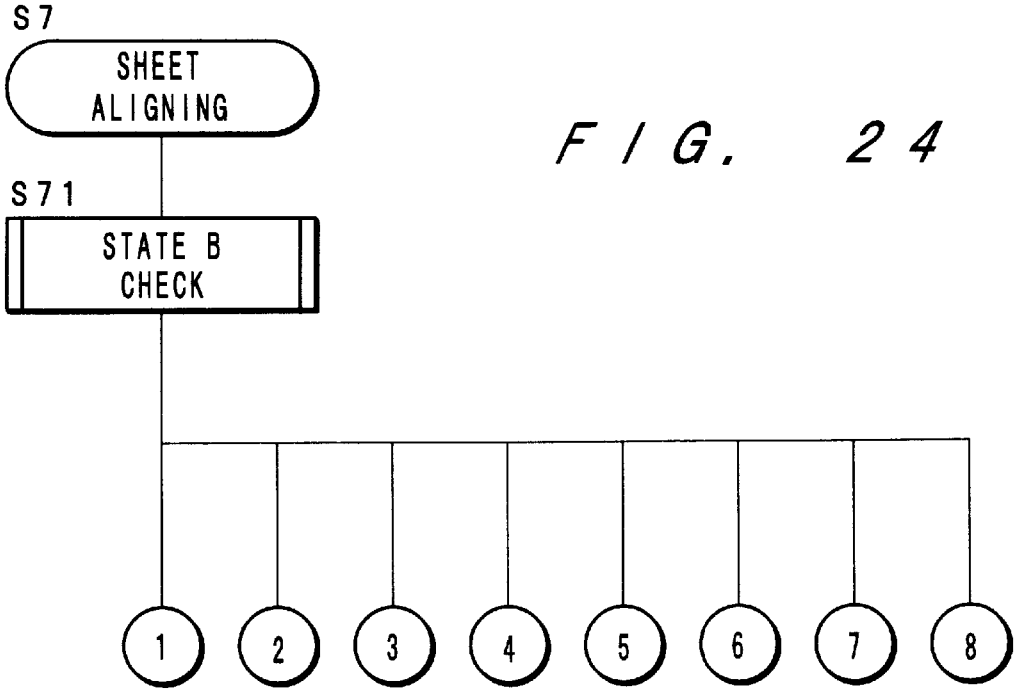
FIG. 24
FIG. 25
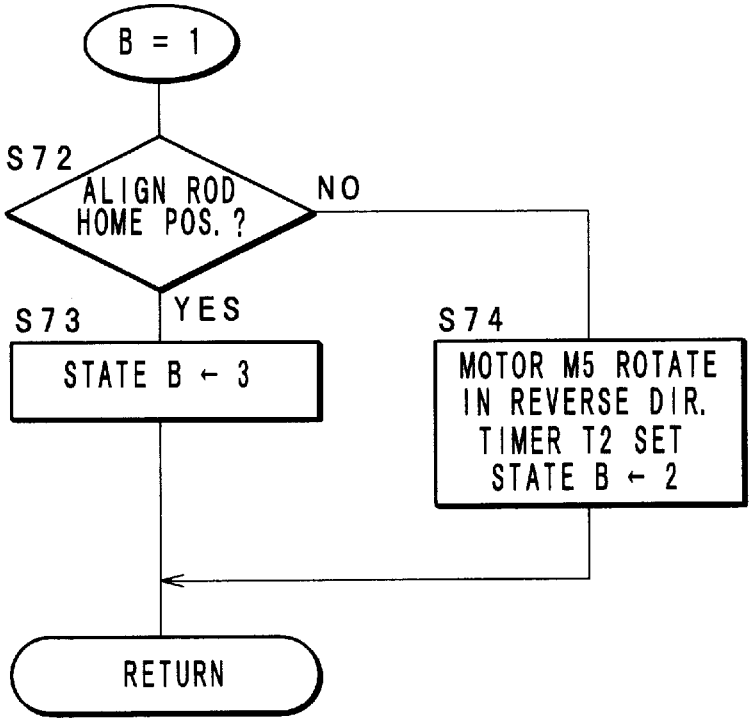

SORTER WITH BIN MOVEMENT CONTROL SYSTEM

This application is based on application No. 9-94246 filed in Japan, the contents of which are hereby incorporated by reference.

BACKGROUND OF THE INVENTION

1. Field of the invention

The present invention relates to an image forming system, more particularly, an image forming system which combines an image forming apparatus such as a copying machine and a printer and a sorter having a plurality of bins which sort sheets.

2. Description of Related Art

Recently, in image forming apparatuses, such as a copying machine and a printer, various sorters which sort image-formed sheets in page order or by each page.

Conventionally, as this kind of sorter, Japanese Patent Publication No. 61-57262 which has a bin assembly comprising a plurality of bins which are movable up and down by one pitch for sorting sheets onto the bins (reciprocating distribution) is well-known.

In this kind of reciprocating distribution sorter, a motion of a bin assembly is efficient, thus, copy productivity is improved. However, when a last sheet is distributed to the bin, it is happened that the bin assembly is stopped at a lower position, and it becomes difficult for an operator to take out sheets. That is, the bin assembly is usually at stand-by at a lower home position, and moves up when an odd number of sheets are sorted, and moves down when an even number of sheets are sorted. After sorting of even number of sheets is finished, the bin assembly is set at the lower position, therefore, an operator has to bend himself/herself to take out the sheets.

On the other hand, Japanese Patent Publication No. 4-23885 discloses a technique that after sorting sheets, with operating a key, bins are moved by one bin to a position where an operator can take out sheets easily. In this technique, however, it takes long time to take out sheets, therefore, it becomes inefficient.

SUMMARY OF THE INVENTION

An object of the present invention is to provide an image forming system which can sort sheets efficiently in reciprocating distribution, and stops a bin assembly at a position where an operator can take out sheets easily when a sheet processing is finished.

In order to attain the object, an image forming system according to the present invention comprises an image forming apparatus which forms images on sheets and discharges the sheets therefrom one by one; a sorter which has a bin assembly comprising a plurality of bins which are movable up and down, the sorter distributing the sheets discharged from the image forming apparatus among the bins while moving up and down the bin assembly pitch by pitch; and a controller which calculates the number of times of switching the direction of movement of the bin assembly based on an image forming mode and determines the bin to which a first sheet is sent and the direction in which the bin assembly is moved first.

Generally, an operator can take out sheets from each bin most easily when the bin assembly is positioned upward. In this case, a bin to receive a first sheet and a first moving direction of the bin assembly are set beforehand in order to set the bin assembly upward when the last processing of sheets is finished. For example, when four originals are processed in the sort mode, a bin to receive a first sheet is set to an upper most bin and a first moving direction of the bin assembly is set to a downward motion, and the bin assembly is moved to an upward position beforehand. With carrying out sort processing in such setting, when the last sheet is sorted, the bin assembly is stopped at the upward position.

In the present invention described above, when the sheet processing is finished, the bin assembly is moved to a position where an operator can take out sheets easily. Thus, the operator can take out sheets efficiently. Further, since the bin assembly is moved to a specified position while an image is formed on a first sheet, efficiency of the image forming processing is not deteriorated.

BRIEF DESCRIPTION OF THE DRAWING

This and other objects and features of the present invention will become apparent from the following description with reference to the accompanying drawings, in which:

FIGS. 10*a* and 10*b* are time charts of bin moving and sheet aligning;

FIGS. 15, 16, 17, 18, 19, 20, 21, 22 and 23 are flowcharts showing a subroutine for bin moving;

FIGS. 24, 25, 26, 27, 28, 29, 30, 31 and 32 are flowcharts showing a subroutine for sheet aligning;

DETAILED DESCRIPTION OF THE PREFERRED EMBODIMENTS

The description of the preferred embodiments according to the present invention is given below, referring to the accompanying drawings. An embodiment below is electrophotographic copying machine combining with a sorter.

Figure 1:
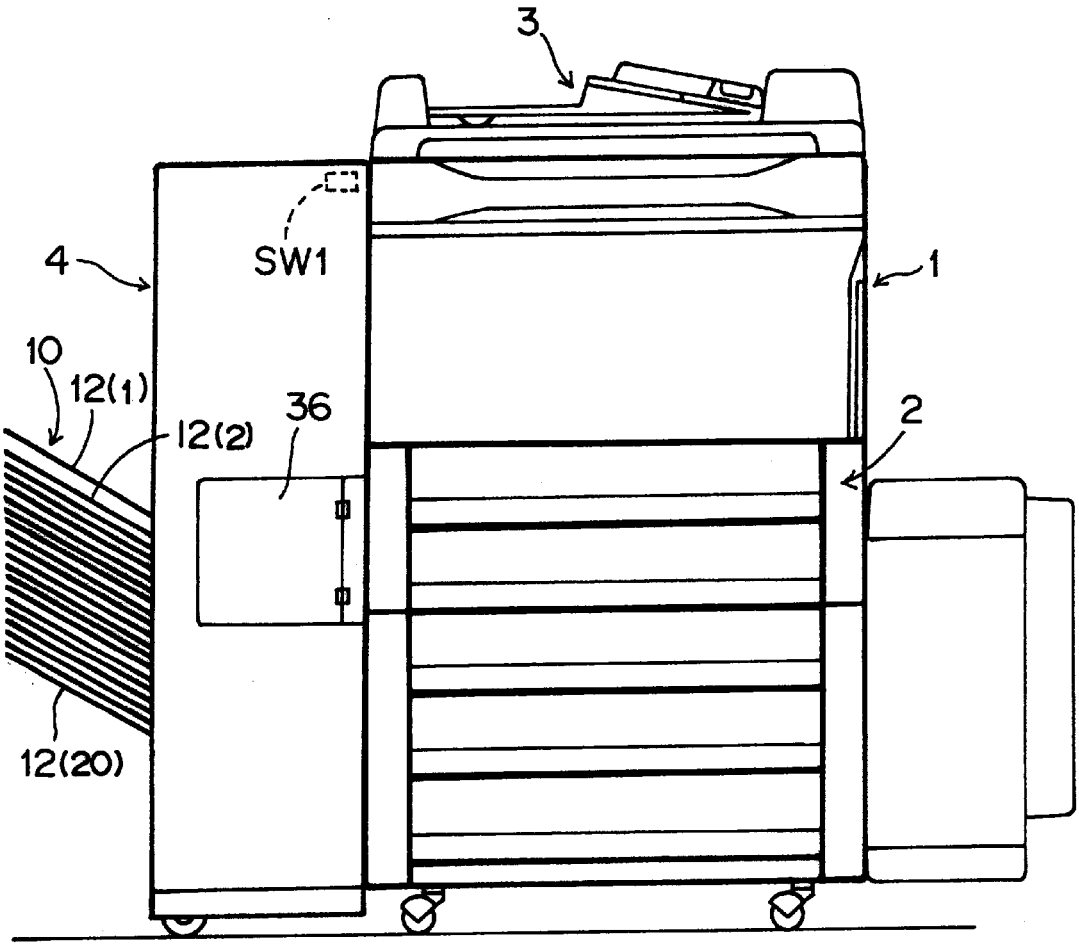
FIG. 1 is a front view of an electrophotographic copying system provided with a sorter which is an embodiment of the present invention.

Referring to FIG. 1, a copying system provided with the embodiment is generally described. In a copying machine 1, an original image is copied on a sheet by a conventional electrophotographic method. A five-story automatic sheet feeder 2 is provided below the machine 1, and an automatic document feeder 3 which feeds originals onto a platen glass one by one is provided above the machine 1.

A sorter 4 is provided in the left side of the machine 1. The sorter 4 not only distributes sheets ejected from the machine 1 to bins 12 but also staples the sheets with a stapler. The sorter 4 is detachable from the machine 1 for maintenance and management of sheet jamming. The attachment and detachment of the sorter 4 is detected by a set switch SW1. Only while the set switch SW1 detects the sorter 4 being attached to the machine 1, the sorter 4 is operational.

Figure 2:
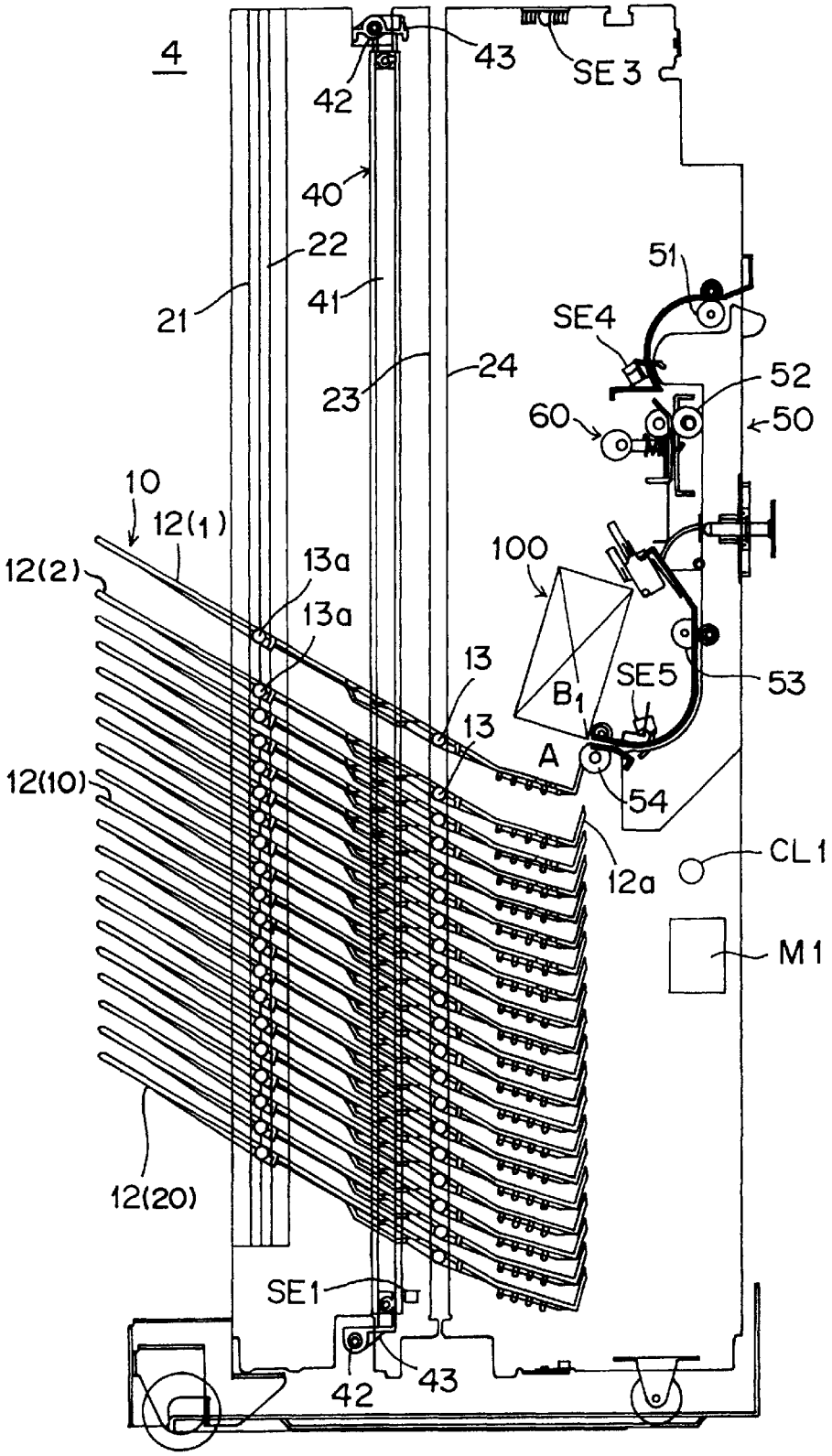
FIG. 2 is an elevational view of the sorter, showing the internal composition thereof.
Figure 3:
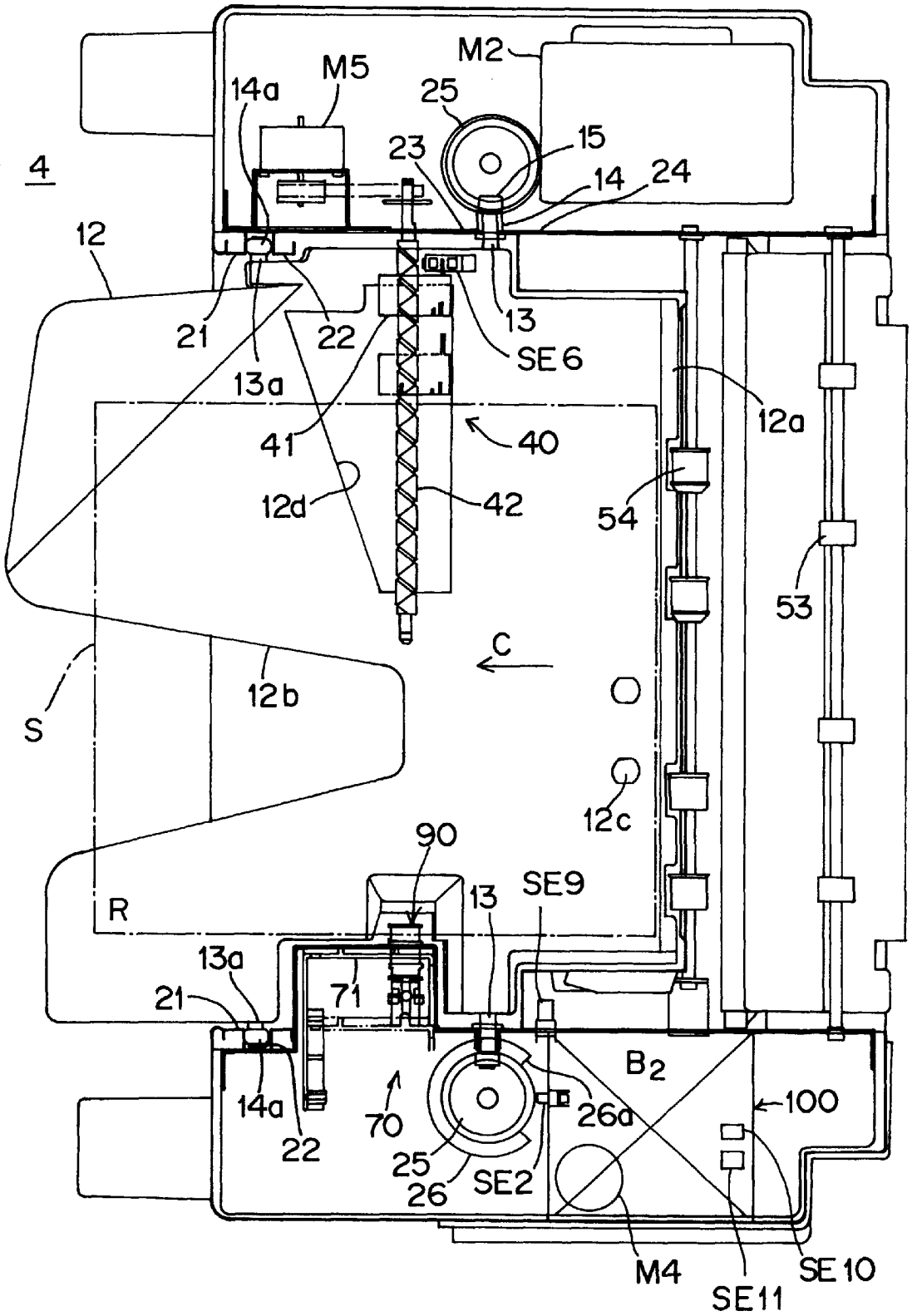
FIG. 3 is a plan view of the sorter, showing the internal composition thereof.

FIGS. 2 and 3 show the general structure of the sorter 4. The sorter 4 comprises a bin assembly 10, a sheet transporting mechanism 50, a punching mechanism 60, a sheet aligning mechanism 40, a sheet chucking mechanism 70 and a stapler 100.

Bin Assembly

In the bin assembly 10, bins $\mathbf{12}_{(1)}$ through $\mathbf{12}_{(20)}$ are arranged vertically one upon another at a specified interval. Sheets are handed into the bins 12 at a position A in FIG. 2. The bins 12 are movable up and down to receive sheets at the hand-out position A. Stapling operation is carried out at a level $B_1$ in FIG. 2 (horizontally, at a position $B_2$ in a plan view of FIG. 3) by the stapler 100. For the stapling operation, each bin 12 moves one step up to the stapling level $B_1$ from the sheet hand-out position A.

Sheet Transporting Mechanism

The sheet transporting mechanism 50 is a sheet path from the machine 1 to the bins 12. The punching mechanism 60 for punching a hole at a rear portion of the sheet, and sheet sensors SE4 and SE5 are disposed in the sheet path. The sheet transporting mechanism 50 has a recieving roller pair 51 which faces a sheet outlet, transport roller pairs 52 and 53 and a hand-out roller pair 54 which send the sheets to the bins 12. These roller pairs are driven by a transport motor M1 through a conventional transmission mechanism. The receiving roller pair 51 and the transport roller pair 52 are connected to the transport motor M1 such that the power of the motor M1 is transmitted to these pairs 51 and 52 at all times. The power transmission to the transport roller pair 53 and the hand-out roller pair 54 can be connected and disconnected by an electromagnetic clutch CL1.

A copied sheet which is ejected from the copying machine 1 is received by the receiving roller pair 51 and goes through the punching mechanism 60. Next, the sheet is received by the transport roller pair 53 and ejected via the hand-out roller pair 54 to each bin 12. The description of the structure and the operation of the punching mechanism 60 is omitted.

Bin moving mechanism

As shown in FIG. 3, each bin 12 is shaped like a plate. Each bin 12 has a sheet reflow prevention wall 12*a* in its supported end and has a large cut-out 12*b* in its free end. The cut-out 12*b* helps an operator take sheets out of the bins 12. Two couples of pins 13 and 13*a* stand on both sides of each bin 12. Rollers 14 and 15 (see FIG. 5) are rotatably fitted to each of the pins 13, and a roller 14*a* is rotatably fitted to each of the pins 13*a*. Each roller 14a is disposed between guide plates 21 and 22 which extend vertically, and is movable up and down. Each roller 14 is disposed between guide plates 23 and 24 which extend vertically, and is movable up and down.

Figure 4:
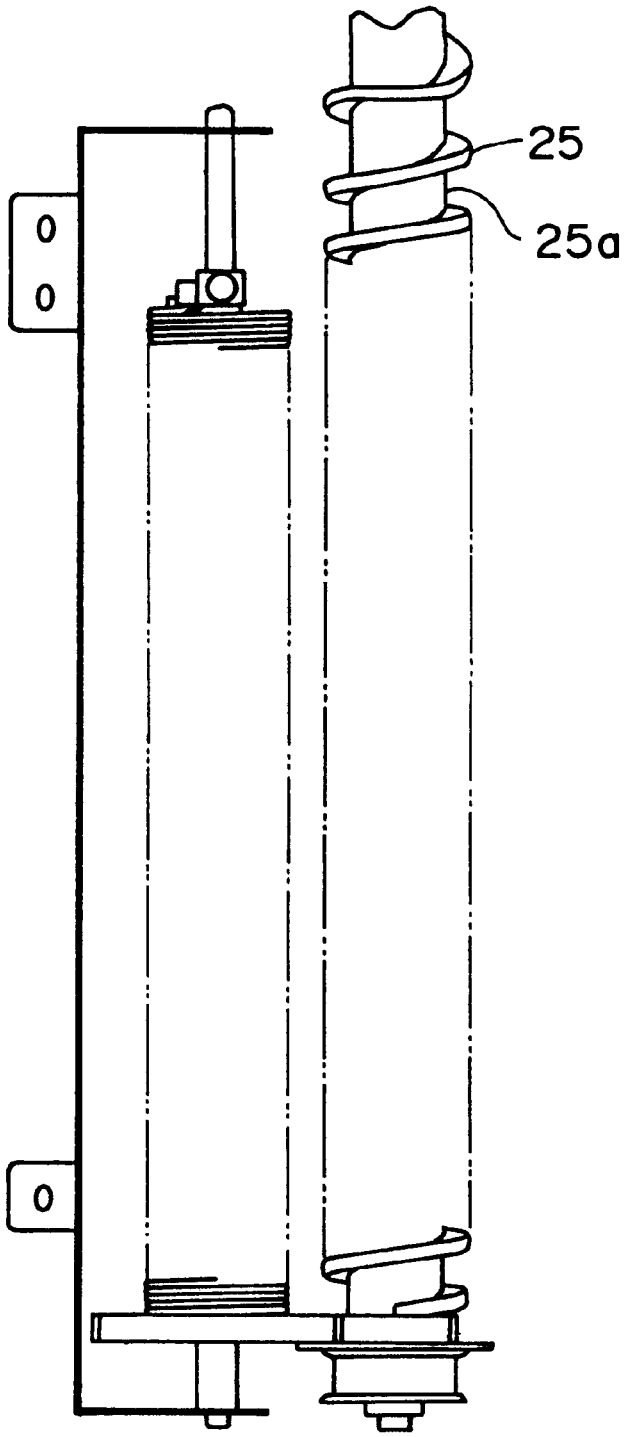
FIG. 4 is an elevational view of a bin moving mechanism.
Figure 5:
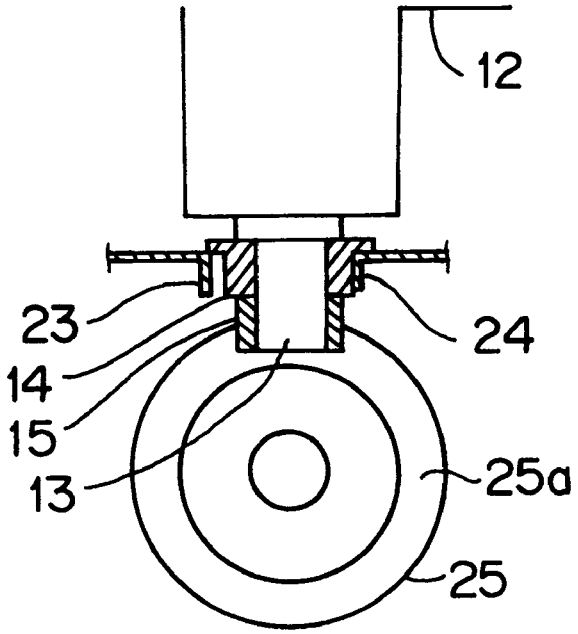
FIG. 5 is a horizontal sectional view of the bin moving mechanism, showing the engagement between a bin driving shaft and rollers.
Figure 6:
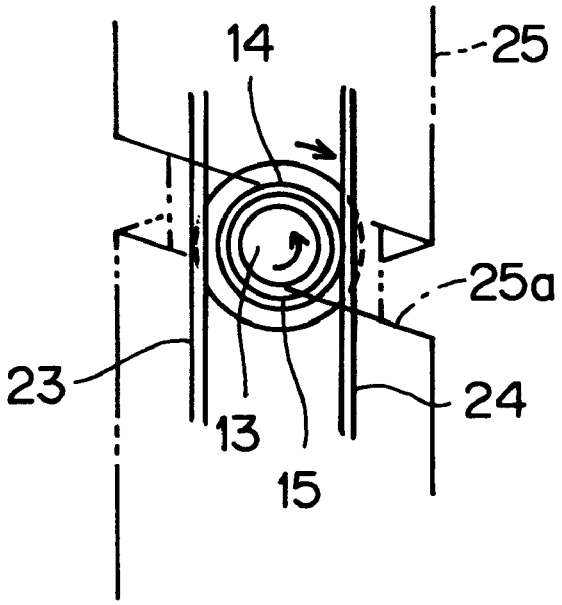
FIG. 6 is an elevational view of the bin moving mechanism, showing the engagement between the bin driving shaft and the rollers.

Driving shafts 25, which are to move the bins 12 wholly up and down, extend vertically at both sides of the bin assembly 10. As shown in FIGS. 4, 5 and 6, each of the driving shafts 25 has a spiral cam groove 25*a* on the circumference, and the roller 15 fitted to the corresponding pin 13 engages with the cam groove 25*a*. A reversible bin motor M2 is disposed in a rear side (upper side of FIG. 3) of the sorter 4, and the motor M2 is connected to the driving shaft 25 in the rear side. The other driving shaft 25 in a front side is connected to the rear side driving shaft 25 by a chain (not shown), and thereby, both the driving shafts 25 rotate synchronously.

The driving shafts 25 hold the bins $\mathbf{12}_{(1)}$ through $\mathbf{12}_{(20)}$ with the cam grooves 25*a*. The intervals among the bins 12 depends on the pitch of the cam grooves 25*a*. As is apparent from FIG. 2, the interval between a bin by the side of the hand-out roller pair 54 (in the hand-out position A) and the next bin is increased because the cam grooves 25*a*, in the position A, has a pitch double the other portions. FIG. 2 shows a state wherein the non-sort bin $\mathbf{12}_{(1)}$ is in the hand-out position A. Then, the driving shafts 25 make one rotation in a normal direction or in a reverse direction, the bin assembly 10 wholly moves up or down by one pitch. In the sorting operation, the bins $\mathbf{12}_{(1)}$ through $\mathbf{12}_{(20)}$ are positioned in the handout position A one by one in this way.

FIG. 2 shows the lowest position of the bin assembly 10, and this position is detected by a sensor SE1. A disk 26 with a cutout 26*a* is fitted to the front side driving shaft 25 (see FIG. 3), and positioning of each bin 12 in the hand-out position A (hereinafter referred to as regular bin position) is detected by monitoring the rotation of the disk 26 with a sensor SE2. Further, a sensor SE3 which detects whether any bin 12 contains any sheet is provided in the sorter 4 (see FIG. 2). The sensor SE3 comprises a light emitting element and a light receiving element, and the optical axis thereof pierces vertically through holes 12*c* made in the bins 12.

Sheet Aligning Mechanism

As shown in FIG. 3, every time a sheet S is received by a bin 12, the sheet aligning mechanism 40 aligns the sheet S in the bin 12 by using an aligning reference plate 71. Also, after stapling operation, the stapled sheets S on each bin 12 are aligned to a front side. More particularly, each bin 12 has an opening 12*d*, and an aligning rod 41 stands vertically so as to pierce through these openings 12*d* of all the bins 12. In the upper and lower portions of the sorter 4, spiral shafts 42 are provided so as to extend in a direction perpendicular to the direction C in which a sheet S is handed into the bin 12. The spiral shafts 42 are connected to an aligning motor M5 and is rotatable in the normal and reverse directions. Upper and lower ends of the aligning rod 41 are fixed on brackets 43 screwed to the respective spiral shafts 42 (see FIG. 2), and the aligning rod 41 moves to the front and rear together with the brackets 43 as the spiral shafts 42 are moving. In FIG. 3, the position of the aligning rod 41 indicated by the solid line is the home position. A sensor SE6 detects whether the aligning rod 41 is in the home position. The aligning motor M5 is a pulse motor. When the motor M5 is driven by a specified number of pulses, the aligning rod 41 moves to the front by a distance according to the number of pulse, which depends on the width of a sheet S to be received by the bin 12. Thus, the aligning rod 41 pushes the sheet S until the other side of the sheet comes into contact with the reference plate 71.

Sheet Chucking Mechanism

The sheet chucking mechanism 70 grabs sheets stored in the bins $\mathbf{12}_{(1)}$ through $\mathbf{12}_{(20)}$ and moves them to the stapling position $B_2$ (see FIG. 3), and after stapling operation, the sheet chucking mechanism 70 returns the sheets to the regular position S in the respective bins $\mathbf{12}_{(1)}$ through $\mathbf{12}_{(20)}$.

This operation is carried out on the same level as the stapling operation level $B_1$ (see FIG. 2).

Figure 7:
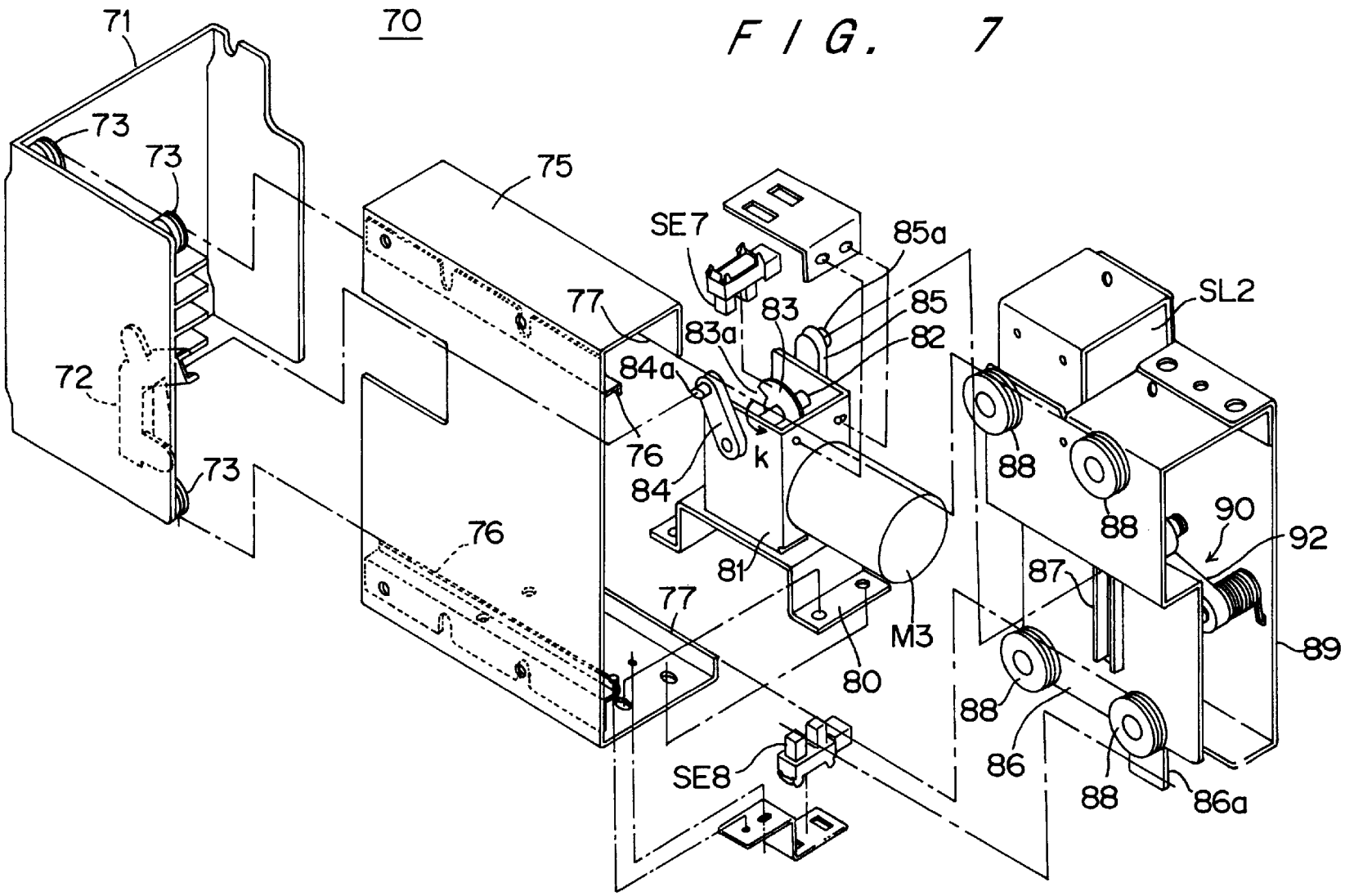
FIG. 7 is a exploded perspective view of a sheet chucking mechanism.
Figure 8:
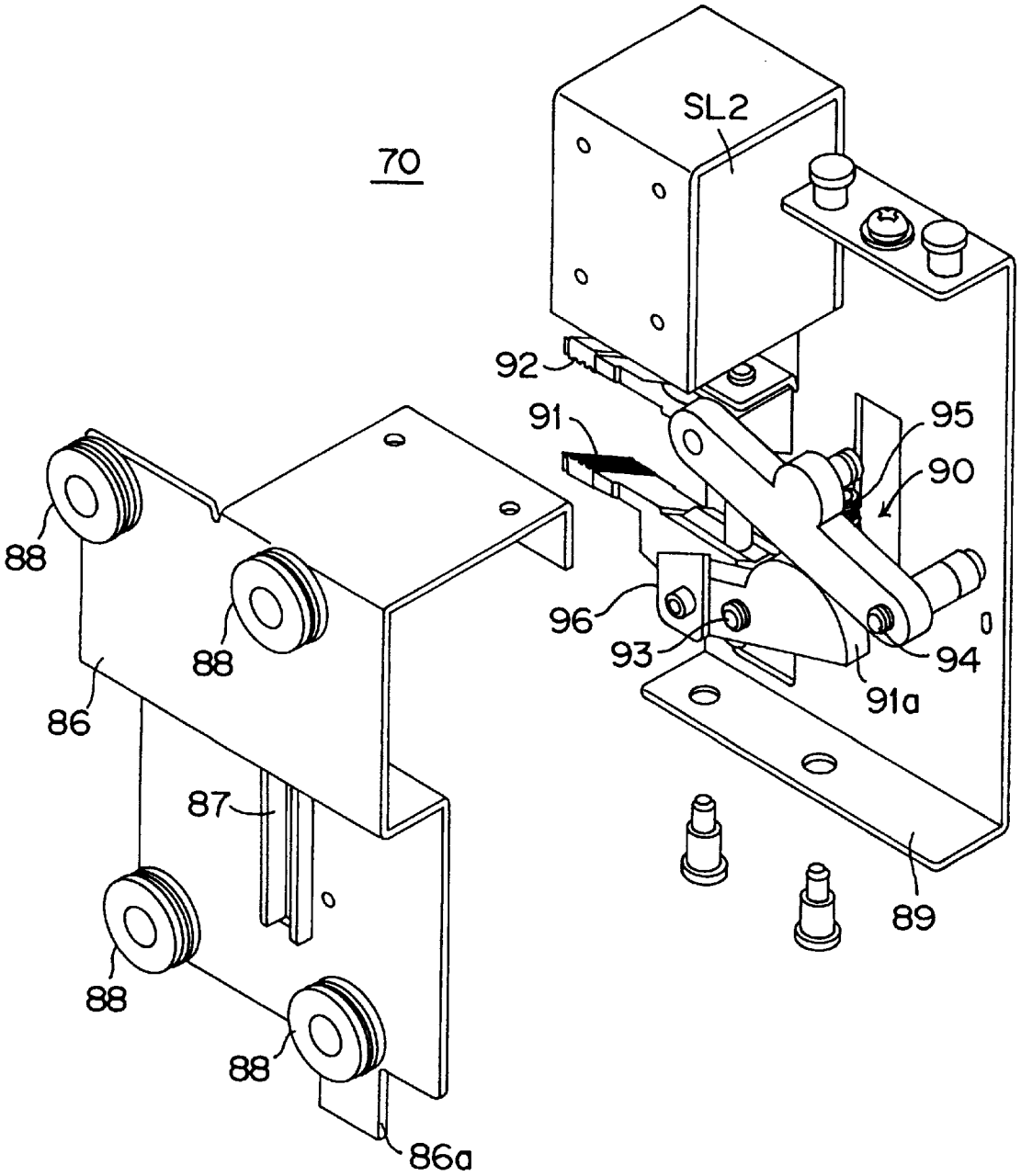
FIG. 8 is an exploded perspective view of a chucking.
Figure 9:
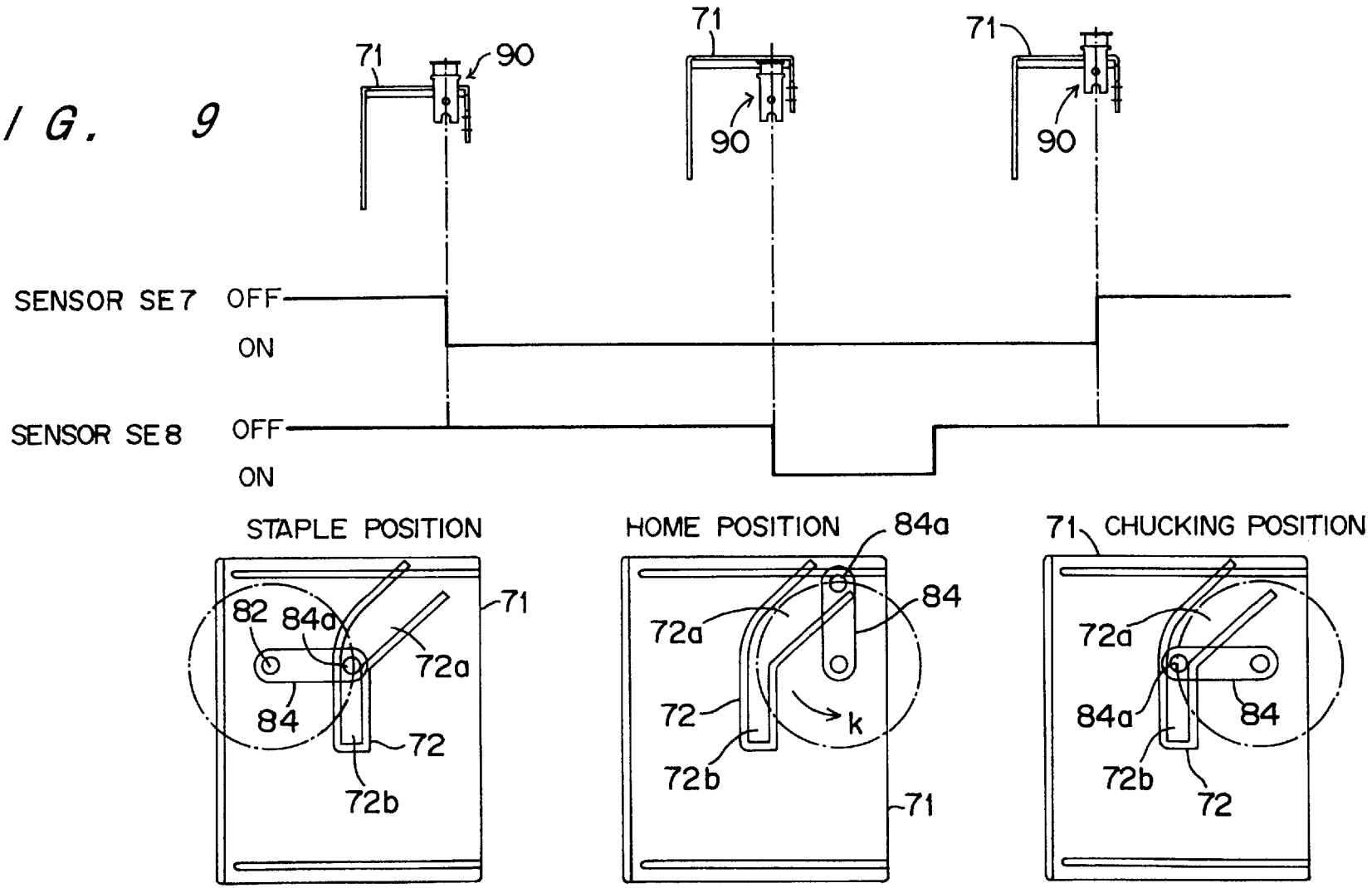
FIG. 9 is an illustration of action of the sheet chucking mechanism.

FIG. 7 and 8 show the structure of the sheet chucking mechanism 70. The chucking mechanism 70 comprises the aligning reference plate 71, a fixed bracket 75, a chucking motor M3, a chucking 90, and movable brackets 86 and 89 which hold the chucking 90. The aligning reference plate 71 has guide rollers 73, and the guide rollers 73 engage with guide plates 76 of the fixed bracket 75. Therefore, the aligning reference plate 71 is slidable. The chucking motor M3 is fitted to the fixed bracket 75 via brackets 80 and 81. The bracket 81 holds a shaft 82, and the motor M3 rotates the shaft 82 in a direction indicated by the arrow k. A lever 84, which has a pin 84*a* at an end, is fitted to an end of the shaft 82, and the pin 84*a* engages with a guide member 72 fitted to the aligning reference plate 71. The guide member 72, as shown in FIG. 9, has an inclined guide groove 72*a* and a vertical guide groove 72*b*. While the lever 84 is turning, the pin 84*a* moves in the guide grooves 72*a* and 72*b*, and consequently, the reference plate 71 moves to the front and rear. The motion of the reference plate 71 is detected by a sensor SE7. The sensor SE7 actually monitors rotation of a disk 83 with a notch 83*a* which is fitted to the shaft 82.

The chucking 90, as shown in FIG. 8, comprises clippers 91 and 92 which are rotatably fitted to the movable bracket 89 via shafts 93 and 94. The lower clipper 91 is connected to an actuator 96 of a solenoid SL2. The clippers 91 and 92 are drawn to each other by a coil spring 95, and a cam surface 91*a* of the clipper 91 is in contact with a lower side of the clipper 92. While the solenoid SL2 is off, the actuator 96 is in a low position, and the ends of the clippers 91 and 92 are open. When the solenoid SL2 is turned on , the actuator 96 moves up, and thereby the lower clipper 91 turns upward on the shaft 93. Meanwhile, the lower side of the upper clipper 92 slides along the cam surface 91*a*, and the clipper 92 turns downward on the shaft 94. Thus, when the solenoid SL2 is turned on, the ends of the clippers 91 and 92 are closed to grab sheets.

The movable bracket 89 is integrated with the movable bracket 86 on which guide rollers 88 are fixed. The guide rollers 88 engage with a guide plate 77 of the fixed bracket 75, and the brackets 89 and 86 are slidable. A lever is fitted to the end of the shaft 82, which is driven by the motor M3, the end being opposite to the end provided with the lever 84. The lever 85 has a pin 85*a* at the end, and the pin 85*a* engages with a guide groove 87 provided on a side of the movable bracket 86. In this structure, the chucking 90 moves to the front and rear as the lever 85 is turning. The motion of the chucking 90 is detected by a sensor SE8. The sensor SE8 actually detects a tab 86*a* of the movable bracket 86.

In stapling one set of sheets, the motor M3 drives the levers 84 and 85 to make one rotation. At the start of drive of the motor M3, the levers 84 and 85 are in upright postures. In this state, the pin 84*a* faces the upper end of the guide groove 72*a*, and the pin 85*a* is in the upper end of the guide groove 87. In this state, the aligning reference plate 71 and the chucking 90 are in the home positions (see FIG. 9), and the aligning reference plate 71 in the position regulates a side of a sheet S shown in FIG. 3. When the motor M3 is turned on, the pin 84*a* moves into the guide groove 72*a*. The aligning reference plate 71 keeps in the home position and the sensor SE7 keeps on until the lever 84 turns in the direction of arrow k by 90 degrees. Meanwhile, by the engagement of the pin 85*a* with the guide groove 87, the chucking 90 moves to the rear toward. The sensor SE8 is turned on when the motor M3 is turned on. When the lever 85 turns by 90 degrees, the chucking 90 comes to the rear most. At that time, the sensor SE7 is turned off, and the solenoid SL2 is turned on to make the clippers 91 and 92 grab the sheets. The sensor SE8 is turned off while the chucking 90 is moving to the rear. While the levers 84 and 85 are turning from 90 degrees to 270 degrees, both the aligning reference plate 71 and the chucking 90 move to the front and draw the sheets to the stapling position $B_2$. When the rotation of the levers 84 and 85 becomes 270 degrees, the sensor SE7 is turned on, and the stapler 100 is driven to staple the sheets. After the stapling, the solenoid SL2 is turned off, and the sheets are relieved from the clippers 91 and 92.

Thereafter, while the levers 84 and 85 turning from 270 degrees to 360 degrees, the aligning reference plate 71 and the chucking 90 move from the rear to the home positions. Thereby, the stapled set of sheets are pushed back in the regular position in the bin 12.

Further, a sensor SE9 (see FIG. 3) is provided to detect whether the chucking 90 brings the sheets to the stapling position $B_2$.

Stapler

The stapler 100 is a conventional electric type. A motor M4 drives a tap (not shown) to hit a staple in sheets. A lot of straight staples are stuck together by adhesive to be in the shape of a sheet, and a cartridge contains a number of such staple sheets. The staple cartridge is loaded in the stapler 100 through a small door 36 shown in FIG. 1.

The stapler 100 has a sensor SE10 which detects whether the tap is in the home position and a sensor SE11 which detects whether there are staples.

Next, operation modes of the sorter 4 are described.

Non-Sort Mode

A non-sort mode is a mode of transporting sheets ejected from the copying machine 1 to one or more bins 12.

The operator sets the non-sort mode by use of a key 128 on an operation panel 120. The non-sort mode is an initial mode. In response to the setting of the non-sort mode, the bin assembly 10 is set in the lowest position, which is detected by the sensor SE1. A sheet which has received an image in the machine 1 passes through the transporting mechanism 50 and is received on the first bin $\mathbf{12}_{(1)}$ through the hand-out roller pair 54. Imaged sheets are transported to the first bin $\mathbf{12}_{(1)}$ in this way one after another and piled thereon. When the first bin $\mathbf{12}_{(1)}$ receives a specified number of sheets, the bin assembly 10 moves up by one step, and then, the second bin $\mathbf{12}_{(2)}$ starts receiving sheets. In this way, each time a bin 12 is filled with sheets, the bin assembly 10 moves up by one step such that the next bin 12 can receive successive sheets.

Sort Mode

A sort mode is a mode of sorting sheets ejected from the machine 1 by use of the sort bins $\mathbf{12}_{(1)}$ through $\mathbf{12}_{(20)}$.

The operator sets the sort mode by use of the key 128 on the operation panel 120. In the sort mode, the reciprocating distribution is carried out. For example, in case of sorting sheets successively to bins starting from the first bin $_{(1)}$, a sheet which has received an image in the machine 1 passes through the transporting mechanism 50 and is received on the sort bin $\mathbf{12}_{(1)}$ through the hand-out roller pair 54. As shown in FIG. 10*a*, a specified time (for example, 50 milliseconds) after the trailing edge of the sheet is detected by the hand-out sensor SE5, the bin motor M2 is driven in the normal direction so as to lift the bin assembly 10 by one step.

Subsequently, the aligning motor M5 is driven in the normal direction so as to move the aligning rod 41 to the front. Thereby, the sheet received in the first bin $\mathbf{12}_{(1)}$ is regulated between the aligning rod 41 and the aligning reference plate 71. The moving distance of the aligning rod 41 depends on the sheet size. The aligning motor M5 is driven in the normal direction by a number of pulses which is determined in accordance with sheet size data transmitted from a control section of the machine 1 to a control section of the sorter 4. The aligning motor M5 is driven in the reverse direction by the same number of pulses immediately after the normal rotation. Thereby, the aligning rod 41 is returned to the home position. In the meantime, the next sheet is received on the next bin $\mathbf{12}_{(2)}$. Thereafter, sheets are received on the bins $\mathbf{12}_{(3)}$ through $\mathbf{12}_{(20)}$ one by one in the same manner.

The sorter 4 makes reciprocating distribution when processing sheets of a plurality of pages. That is, after the bin assembly 10 distributes sheets by moving upward step by step, the bin motor M2 is driven in the reverse direction to move the bin assembly 10 downward step by step for receiving the sheets on the bins 12. Also, in case that the bin assembly 10 distributes sheets by moving downward step by step, the bin motor M2 is driven in the normal direction to move the bin assembly 10 upward step by step. Thus, in the reciprocating distribution, when the bin assembly 10 changes from the upward motion to the downward motion or from the downward motion to the upward motion, the uppermost of the used bins or the lowermost of the used bins receives two consecutive sheets which are the last sheet of a page and the first sheet of the next page. While the uppermost or the lowermost of the used bins is receiving two consecutive sheets, the bin assembly 10 does not move, and the sheet aligning operation is carried out earlier than usual. The aligning operation in this case is shown by FIG. 10*b*. After the hand-out sensor SE5 detects the trailing edge of the last sheet of a page, the aligning motor M5 is driven at the timing of driving the bin motor M2 in a usual case. At that time, the sheet which has passed through the handout roller pair 54 is still in the air before falling into the bin 12.

Since the aligning motor M5 is started while the sheet is still in the air, the aligning operation is more effective. If the aligning operation is carried out after the newly-fed sheet falls into the bin 12 and completely sticks to sheets stored in the bin 12, there is a possibility that the friction between the newly-fed sheet and the sheets stored in the bin 12 is so large that the aligning operation is not effective. However, as described, the aligning operation is carried out effectively at an earlier timing.

Sort/Staple Mode

A sort/staple mode is a mode of sorting sheets ejected from the machine 1 and stapling the sheets stored in the sort bins 12 by the stapler 100.

The operator sets the sort mode and the staple mode by use of keys 128 and 129 on the operation panel 120.

First, sheets which have received images in the machine 1 are sorted while the sorter 4 is operating as described above.

The stapling operation is carried out after the sorting operation. In the stapling operation, bins stored with the sheets are moved to the stapling level $B_1$ one by one. The movement to the stapling level $B_1$ starts with a bin which has received the last sheet in the sorting operation. In the present embodiment, when the sorting operation is finished, the uppermost of the used bin 12 is in the sheet hand-out position A. Thus, the bin assembly 10 moves one step up to set the upper most bin 12 to the stapling level $B_1$. After stapling of sheets in the upper most bin 12, the bin assembly 10 moves upward step by step and stapling operation is carried out successively from the uppermost bin to the lowermost bin.

When a specified bin 12 is set to the stapling level $B_1$, the chucking motor M3 is turned on. While the shaft 82 is rotating by 90 degrees, the aligning reference plate 71 stays in the home position shown in FIG. 9, and the chucking 90 moves to the rear from the home position. When the rotation of the shaft 82 becomes 90 degrees, the sensor SE7 is turned off. Simultaneously, the solenoid SL2 is turned on to make the clippers 91 and 92 grab sheets in the bin 12.

Subsequently, while the rotation of the shaft 82 is from 90 degrees to 270 degrees, the chucking 90 moves to the front holding the sheets. The aligning reference plate 71 moves to the front in synchronization with the chucking 90. When the rotation of the shaft 82 becomes 270 degrees, the sensor SE7 is turned on. In this moment, on confirmation that the sensor SE9 detects sheets, the stapler 100 is driven to staple the sheets.

After the stapling, the solenoid SL2 is turned off, whereby the stapled set of sheets are relieved from the clippers 91 and 92. Then, while the shaft 82 continues rotating to 360 degrees, the aligning reference plate 71 returns to the home position pushing the stapled set of sheets back in the regular position in the bin 12. Simultaneously, the chucking 90 returns to the home position.

After one cycle of stapling operation described above, the bin assembly 10 moves up or down by one step, so as to subject sheets stored in the next bin to the stapling operation.

When the stapler 100 is driven and a stapled set of sheets is relieved from the chucking 90, there is a possibility that the stapled set of sheets may be hit and pushed far behind the regular position. Since the operator stands at the front side of the copying machine 1, this makes it inconvenient for the operator to take the stapled set of sheets out of the bin 12. Therefore, in the present embodiment, after completion of the stapling operation toward all the sheets stored in the bins 12, the aligning motor M5 is driven to move the aligning rod 41 to the front. Thereby, the stapled sets of sheets are regulated between the aligning rod 41 and the aligning reference plate 71 and again put in the regular position in the respective bins 12. Thus, the operator can take the stapled sets of sheets out of the bins 12 easily.

Further, in the present embodiment, the processing can be carried out in a combination of a group mode and the staple mode. However, the description thereof is omitted.

Operation Panel

Figure 11:
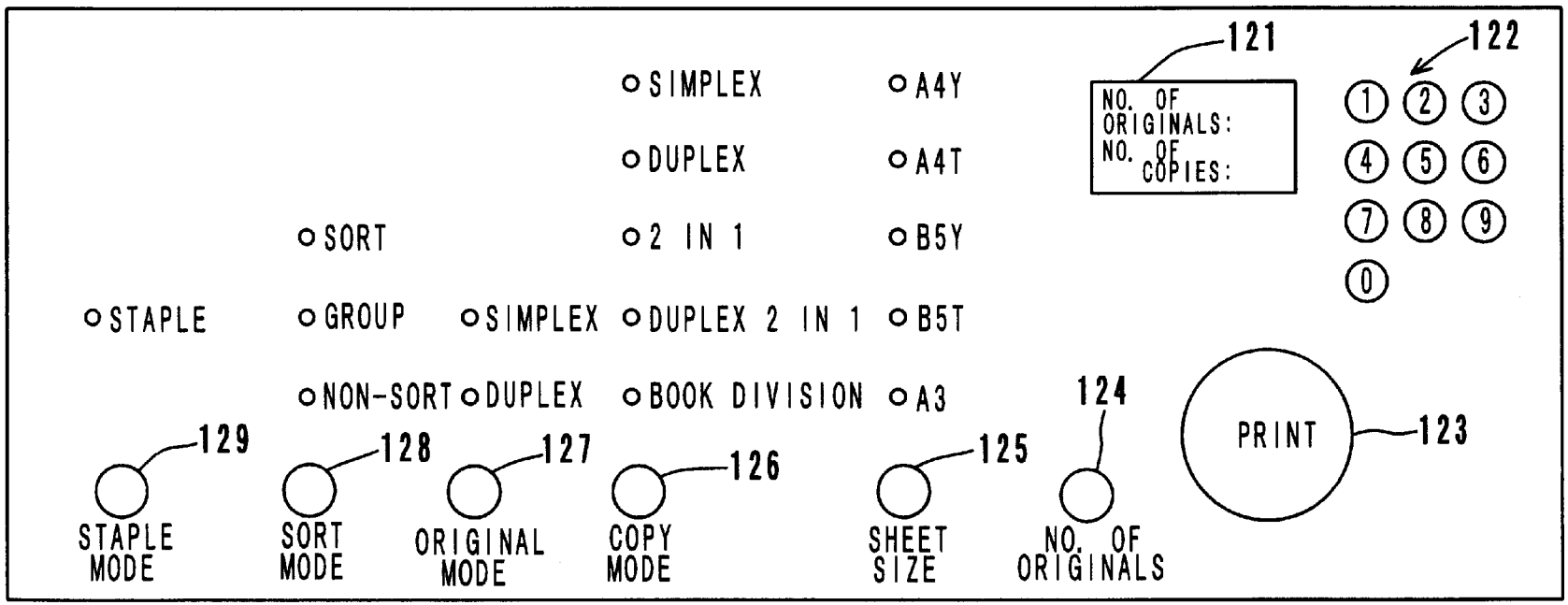
FIG. 11 is a plan view of a operating panel.

FIG. 11 shows the operation panel 120 which is provided on the copying machine 1. On this operation panel 120, a liquid crystal display 121 which indicates a number of originals and a number of copy, a ten key 122, a print key 123, a number of original input key 124, a sheet size input key 125, a copy mode input key 126, an original mode input key 127, a sort mode input key 128, a staple mode input key 129 and various LEDs for indicating inputted mode.

A numeric value inputted through the ten key 122 is indicated at the display 121 as a number of copy. When the operator turns on the input key 124, the inputted numeric value is indicated as a number of originals, and the number of copy indicated is reset to "1". A numeral value inputted after that is indicated as a number of copy.

As for a copy mode inputted through the input key 126, "simplex" is a mode wherein an image is formed only one side of a sheet, and "duplex" is a mode wherein images are formed both sides of a sheet. "2 in 1" is a mode wherein two originals are placed on the platen glass to form two images side by side on one side of a sheet. "duplex 2 in 1" is a mode wherein a couple of two images (four images total) are formed on a front and a back sides of a sheet respectively. "book division" is a mode wherein images on two facing pages of a book original are formed on each single sheet respectively.

As for an original mode inputted through the input key 127, "simplex" is a mode wherein an original which has a image on one side is copied, and "duplex" is a mode wherein an original which has images on both sides is copied.

Control Section

Figure 12:
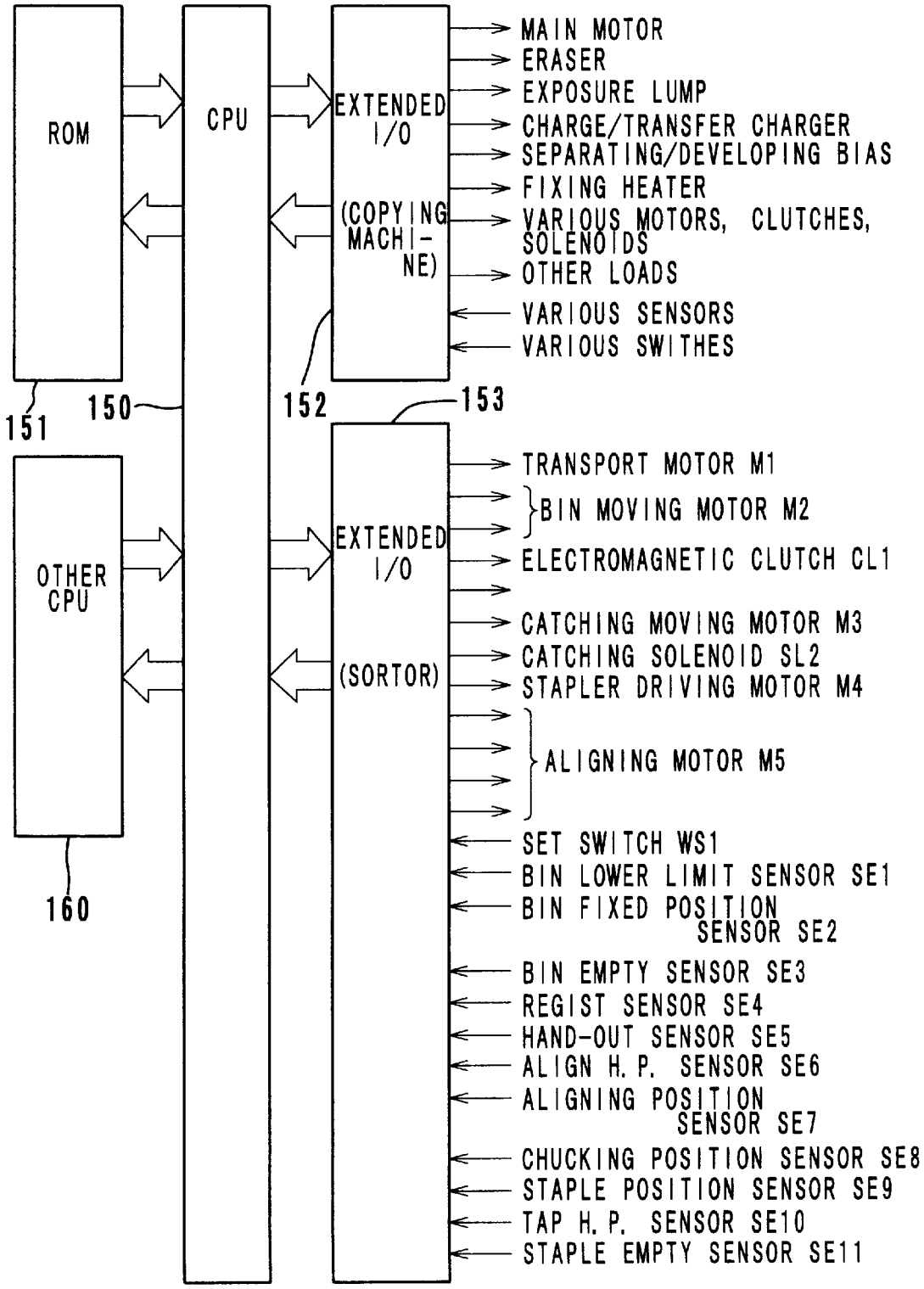
FIG. 12 is a block diagram showing control circuitry of the copying machine and the sorter.

FIG. 12 shows a control section. The control section is mainly composed of CPU 150, and controls the copying machine 1 and the sorter 4. The CPU 150 is provided with a ROM 151 which stored a control program, and communicate with another CPU 160 which controls an automatic document feeder 3. Various sensors and various devices contained in the copying machine 1 are connected with an extended I/O 152 of the CPU150, and various sensors and various devices contained in the sorter 4 are connected with an extended I/O 153.

Control Procedure

Figure 13:
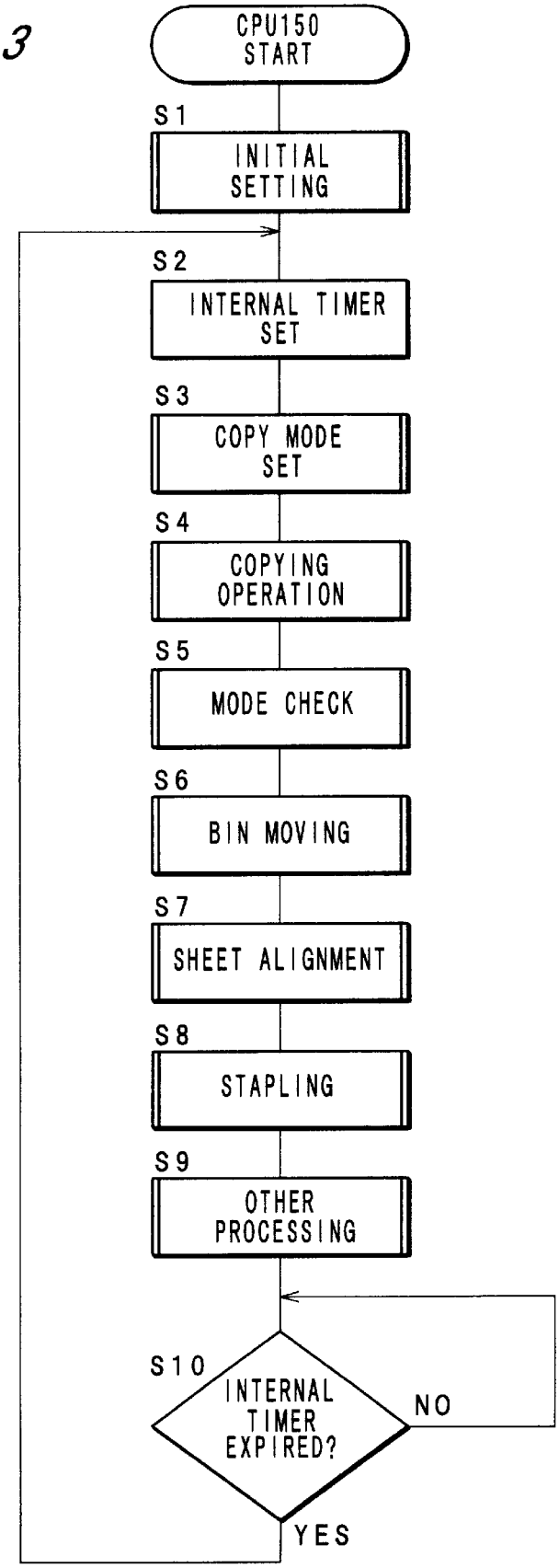
FIG. 13 is a flowchart showing a main routine of a CPU which controls the copying machine and the sorter.

FIG. 13 shows a main routine of the CPU 150 which controls the copying machine 1 and the sorter 4.

When the CPU 150 is reset and starts a program, first, initialization, such as clearance of an internal RAM, clearance of registers and initial setting of devices, is carried out at step S1. Next, an internal timer is set at step S2. The internal timer determines a time for one cycle of the main routine, and the value is determined beforehand at step S1.

Subsequently, a subroutine for copy mode setting at step S3, a subroutine for copying operation at step S4, a subroutine for mode checking at step S5, a subroutine for bin moving at step S6, a subroutine for sheet alignment at step S7, a subroutine for stapling at step S8 and a subroutine for other processing such as controlling a temperature of the fixing device and trouble checking are called in order, and necessary processing is carried out. Subroutines for copy mode setting and copying operation at steps S3 and S4 are well known, and the description thereof is omitted.

On confirmation of the expiration of the internal timer at step S10, the processing returns to step S2. Based on the time for one cycle of main routine, various timers are set in the respective subroutines.

Figure 14:
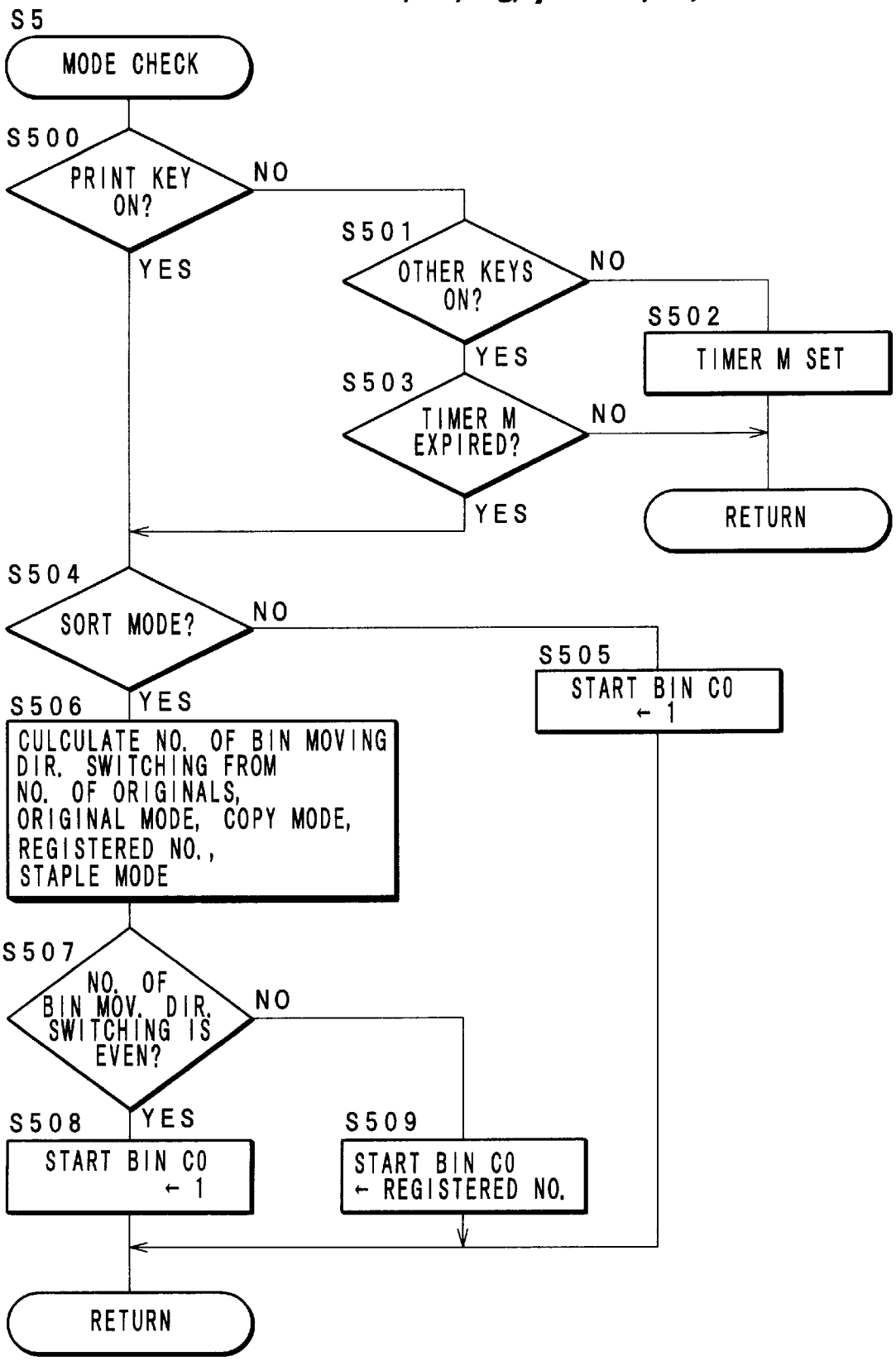
FIG. 14 is a flowchart showing a subroutine for mode checking.
Figure 17:
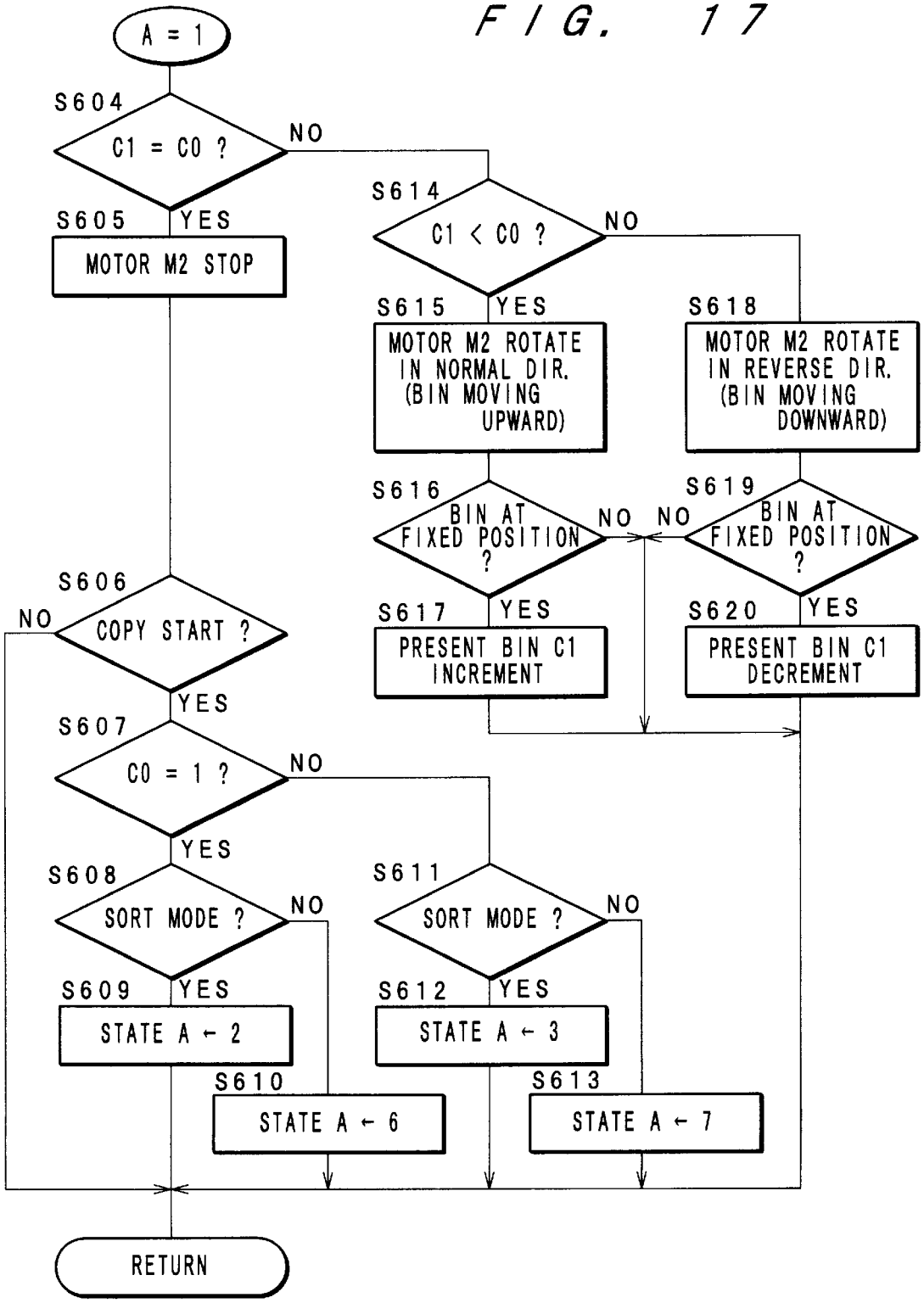
Figure 18:
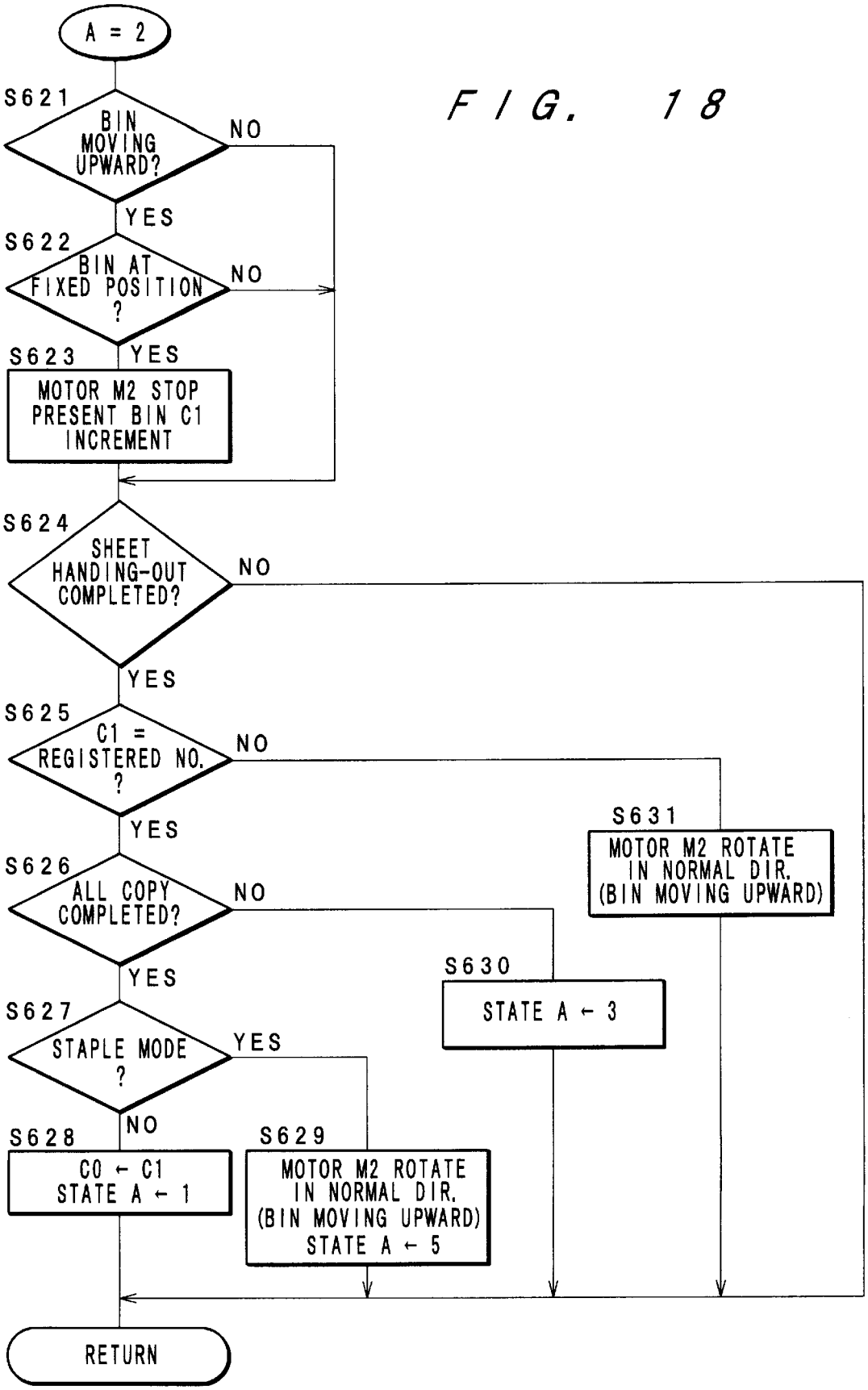
Figure 19:
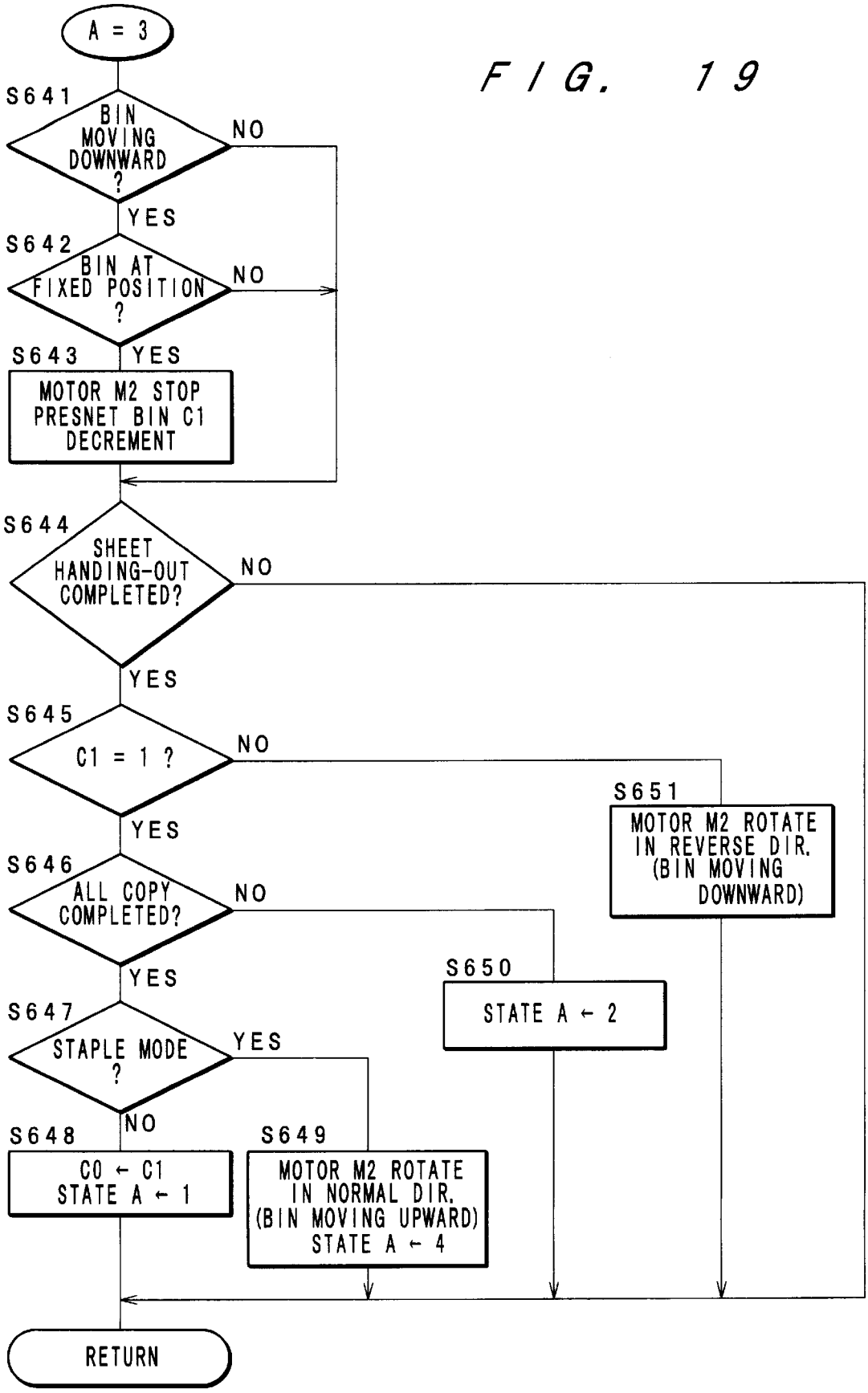
Figure 20:
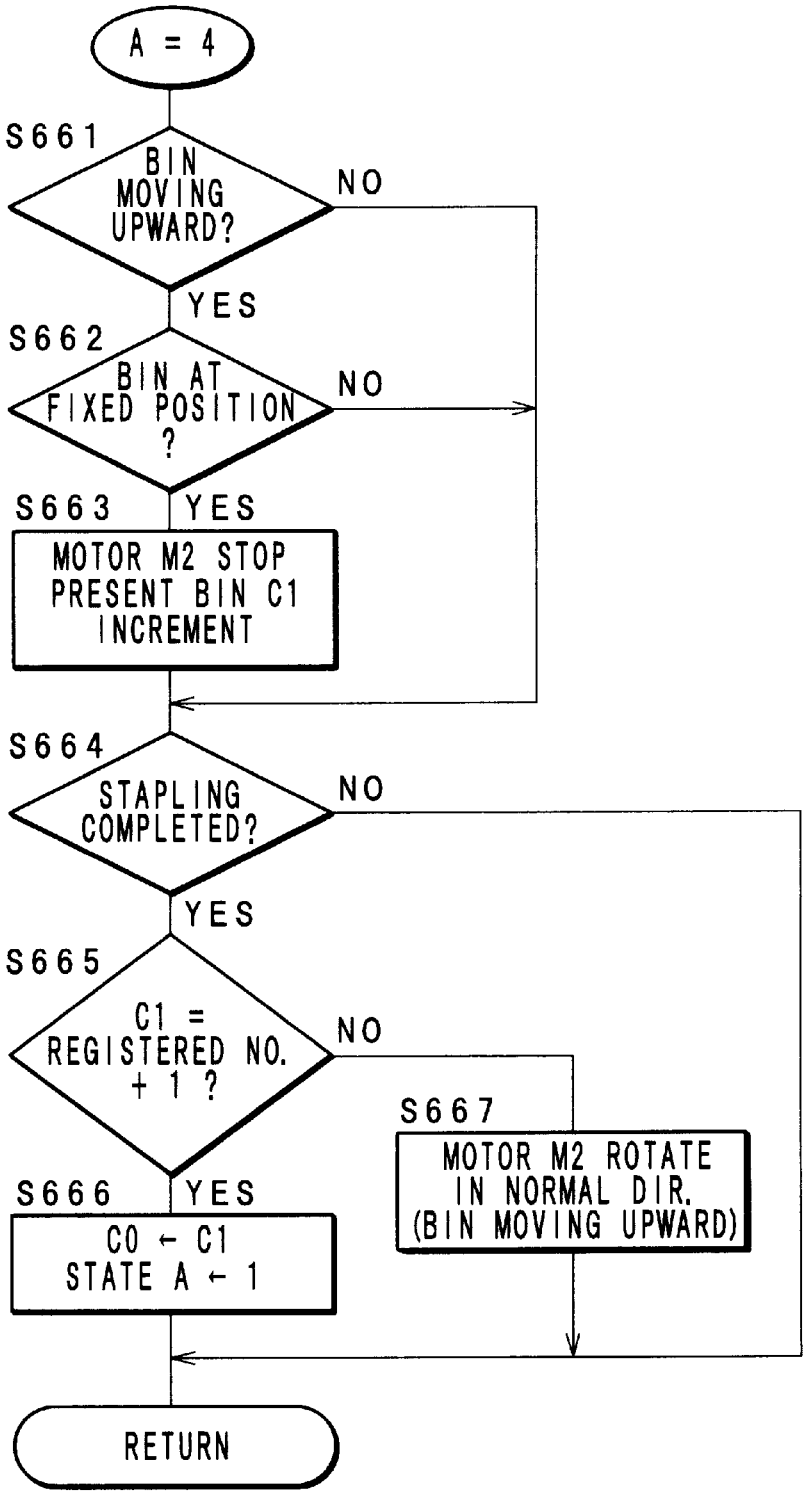
Figure 21:
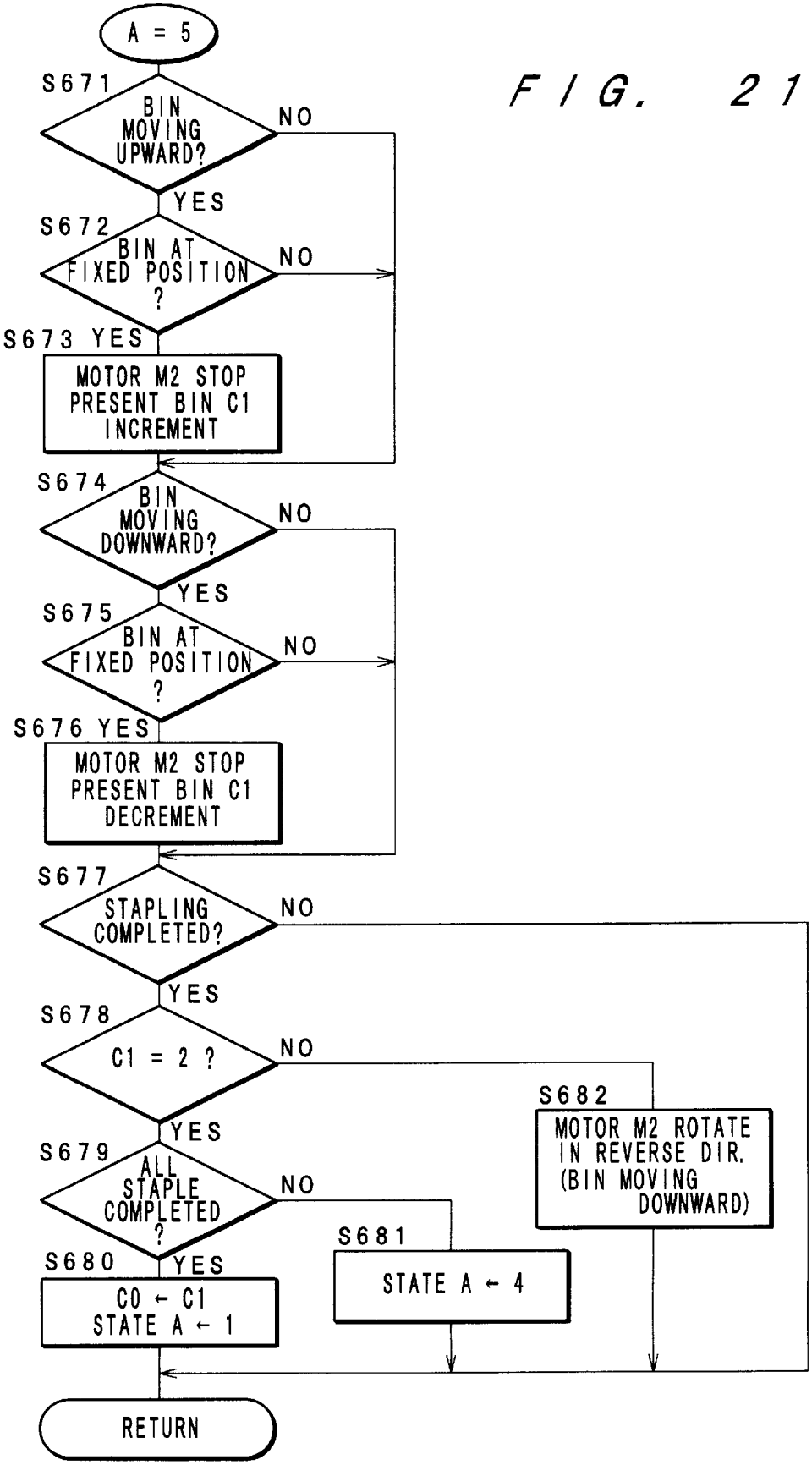
Figure 22:
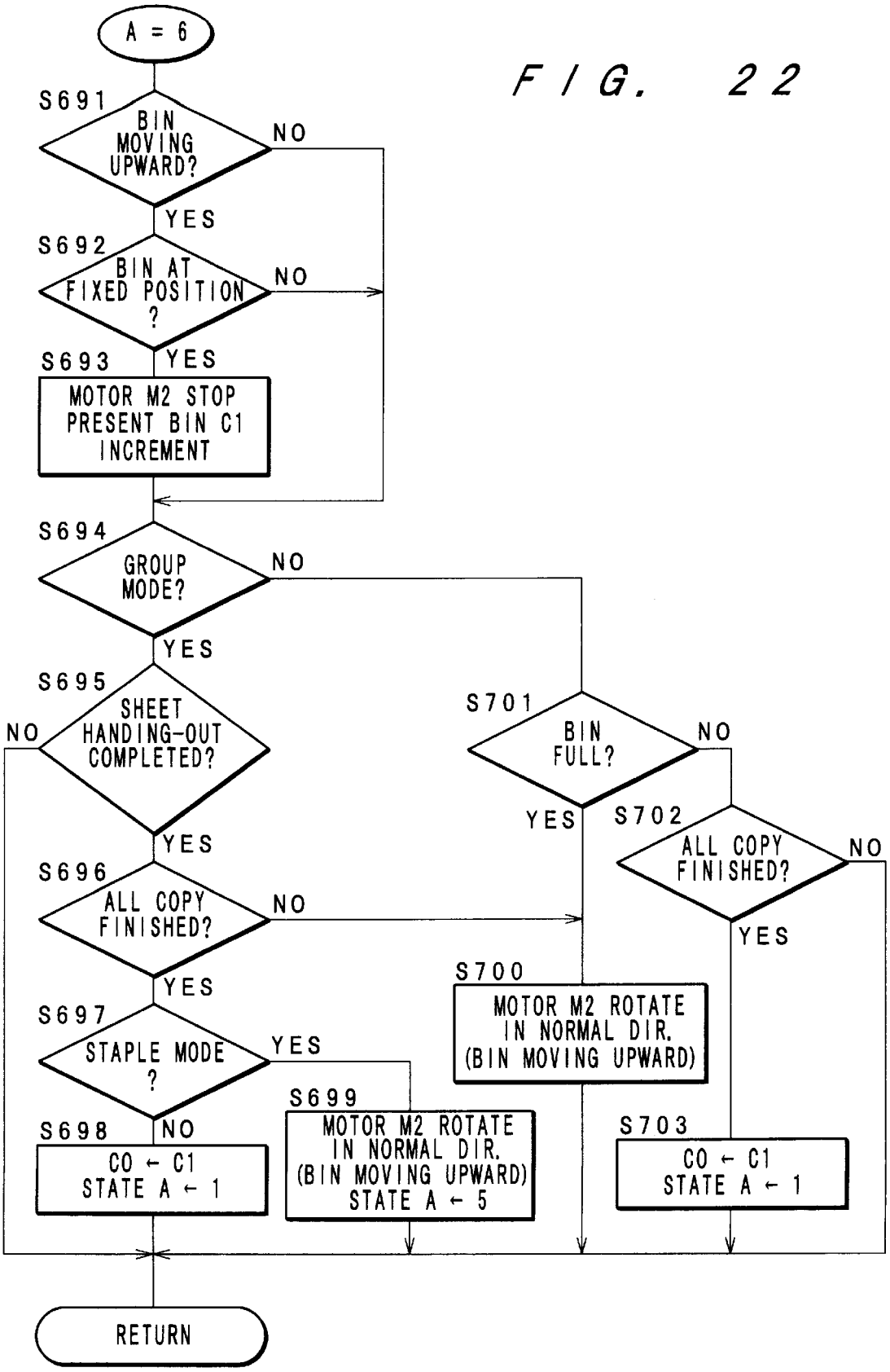
Figure 23:
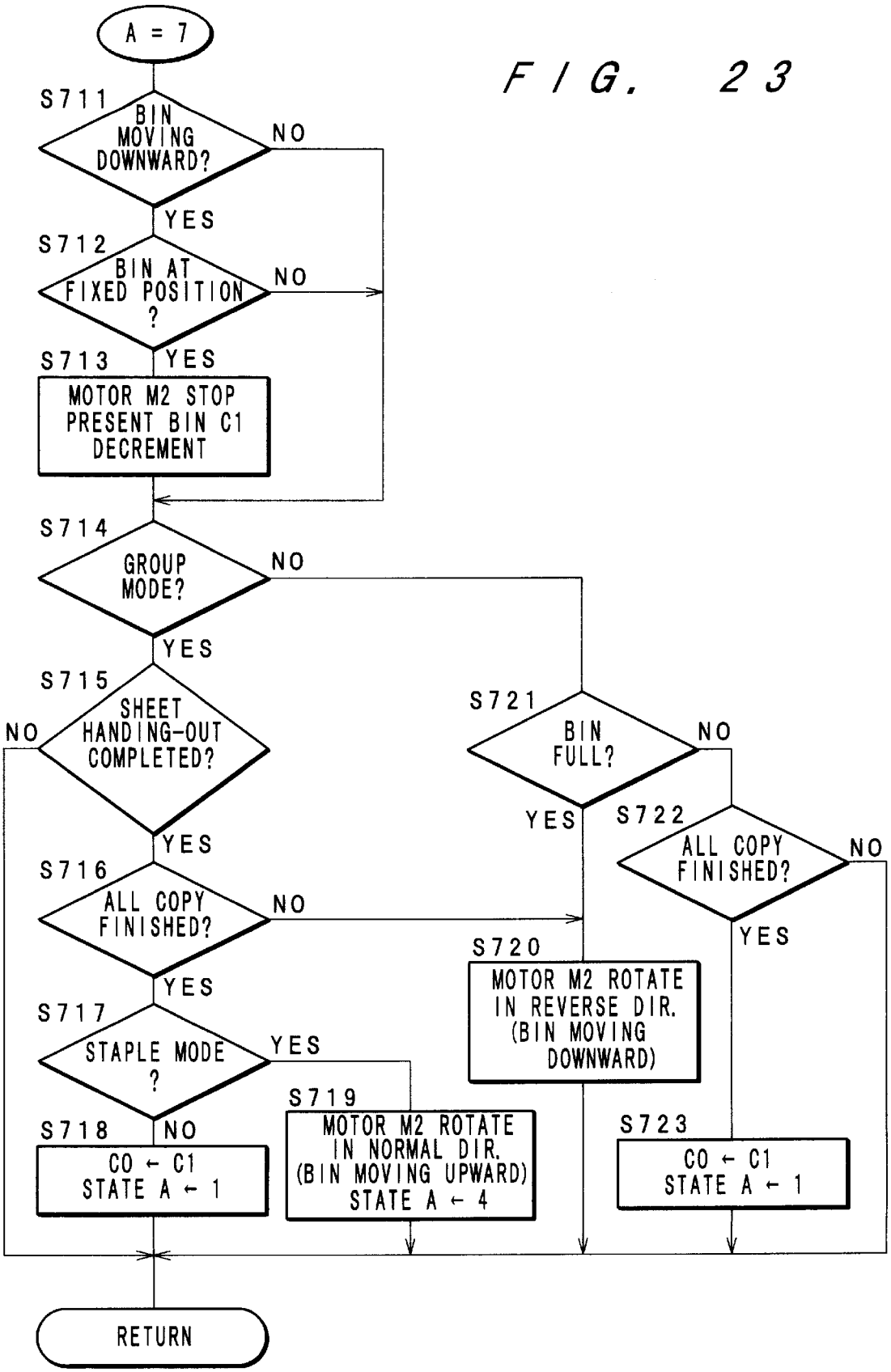
Figure 26:
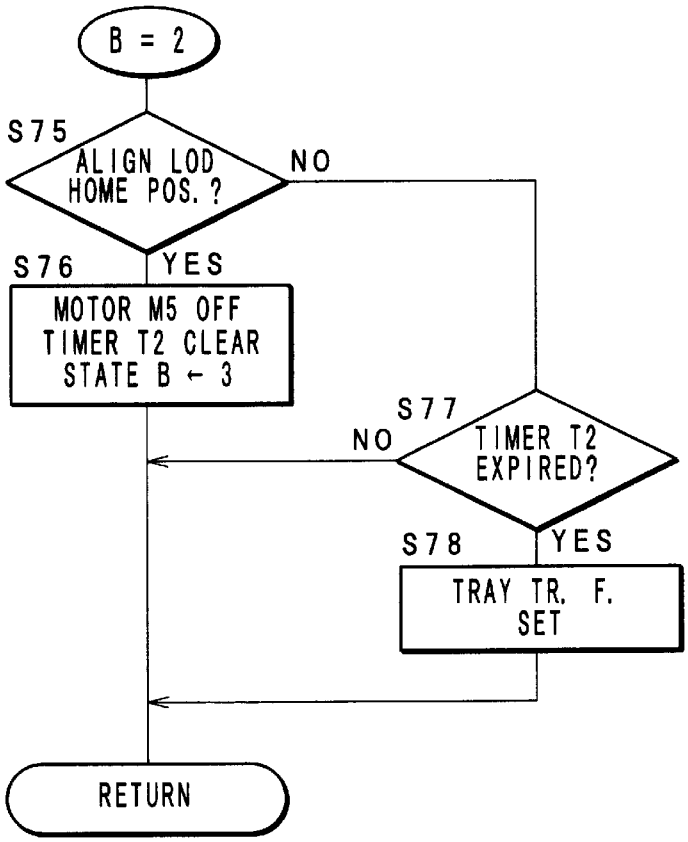
Figure 27:
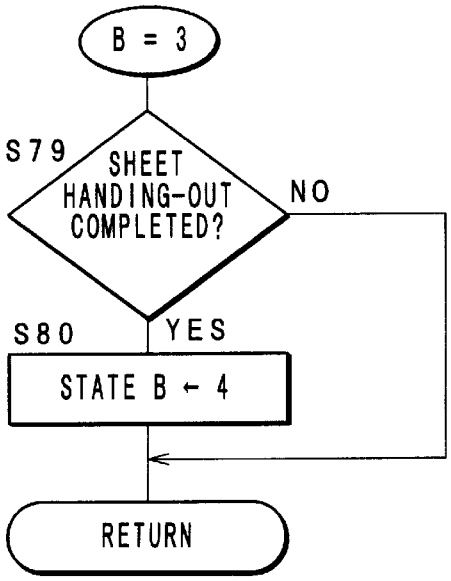
Figure 28:
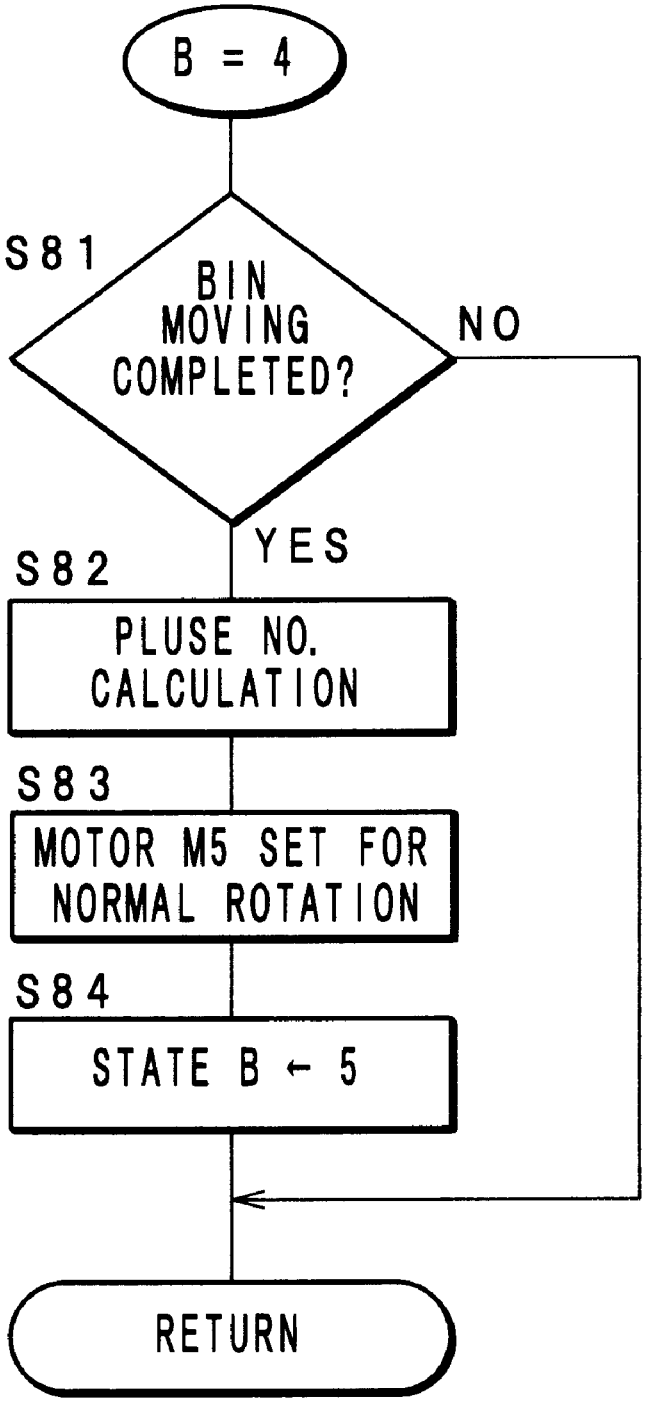
Figure 29:
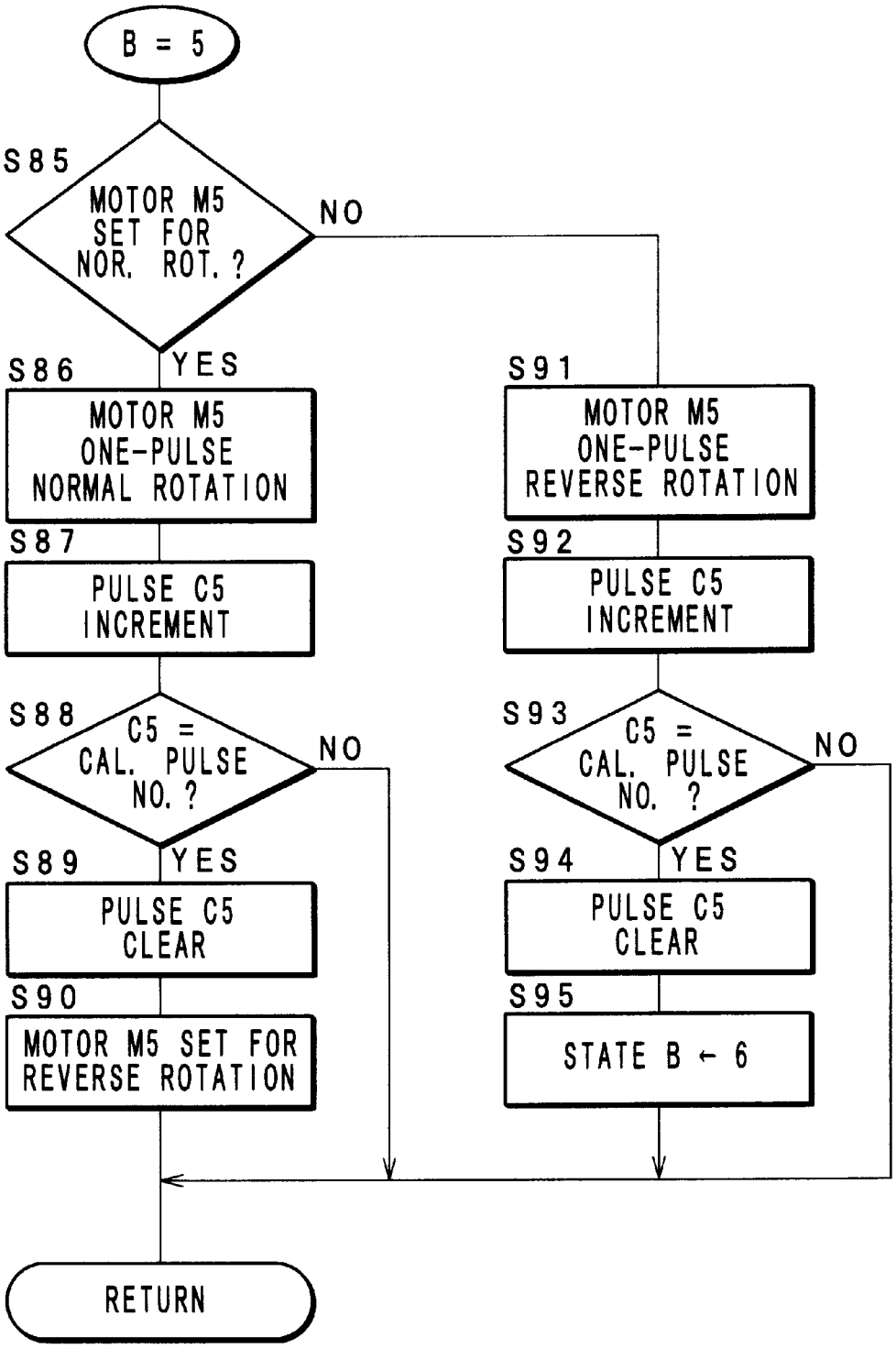
Figure 30:
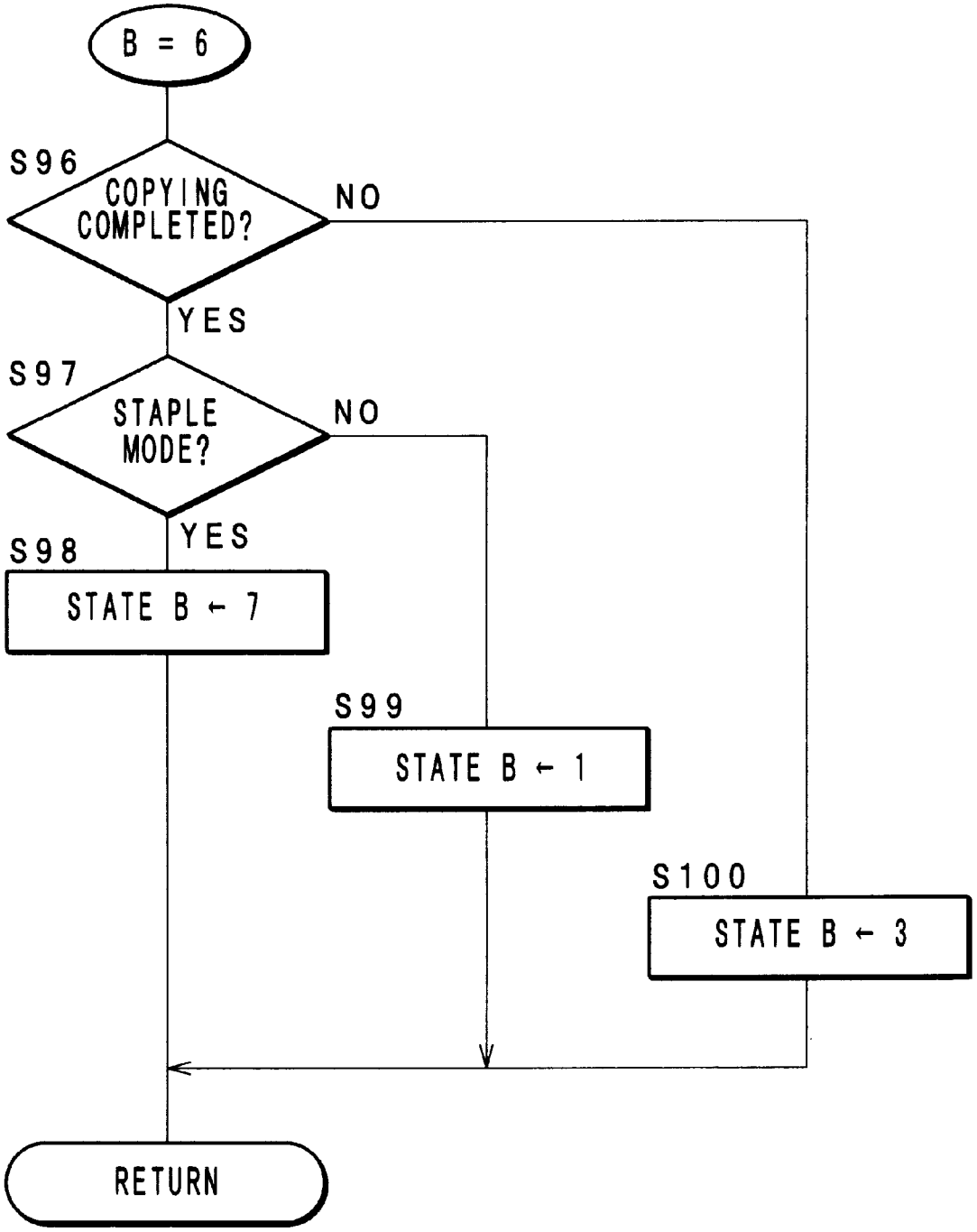
Figure 31:
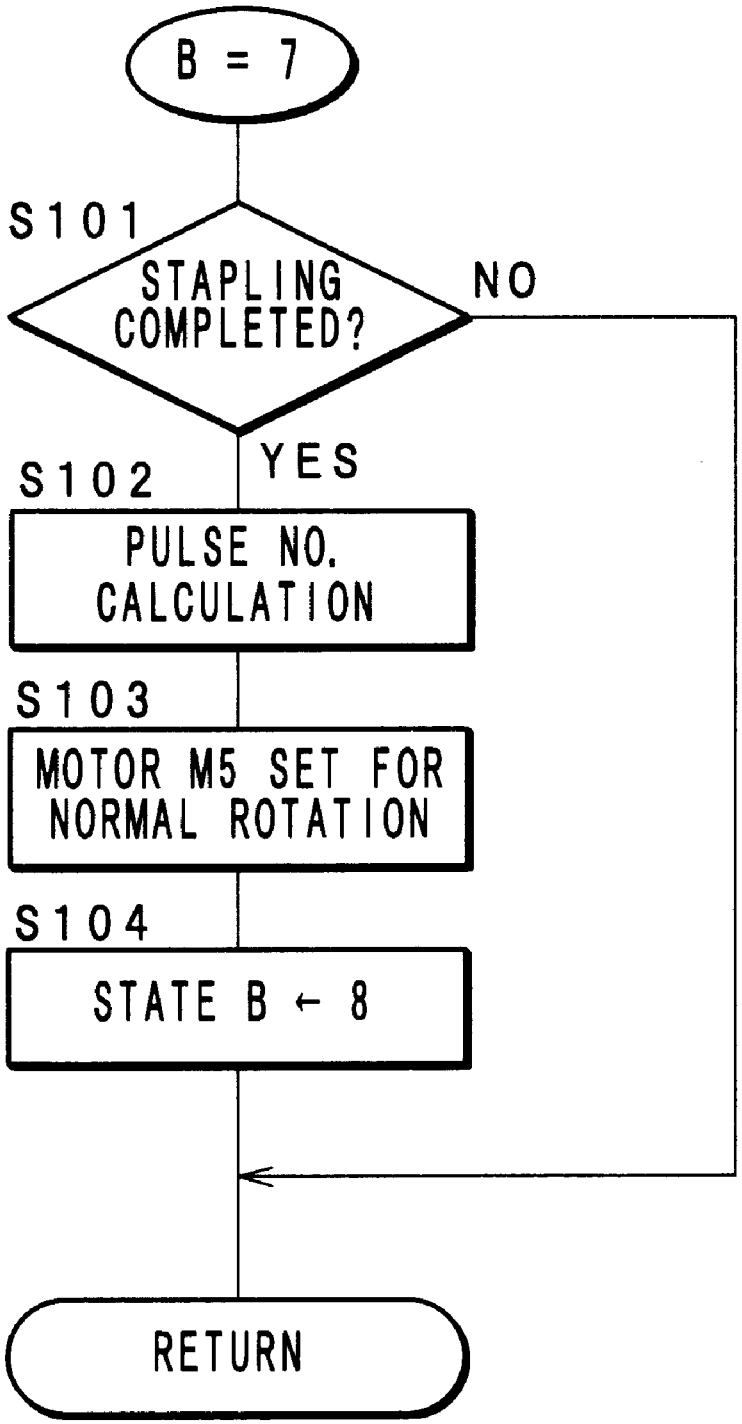
Figure 32:
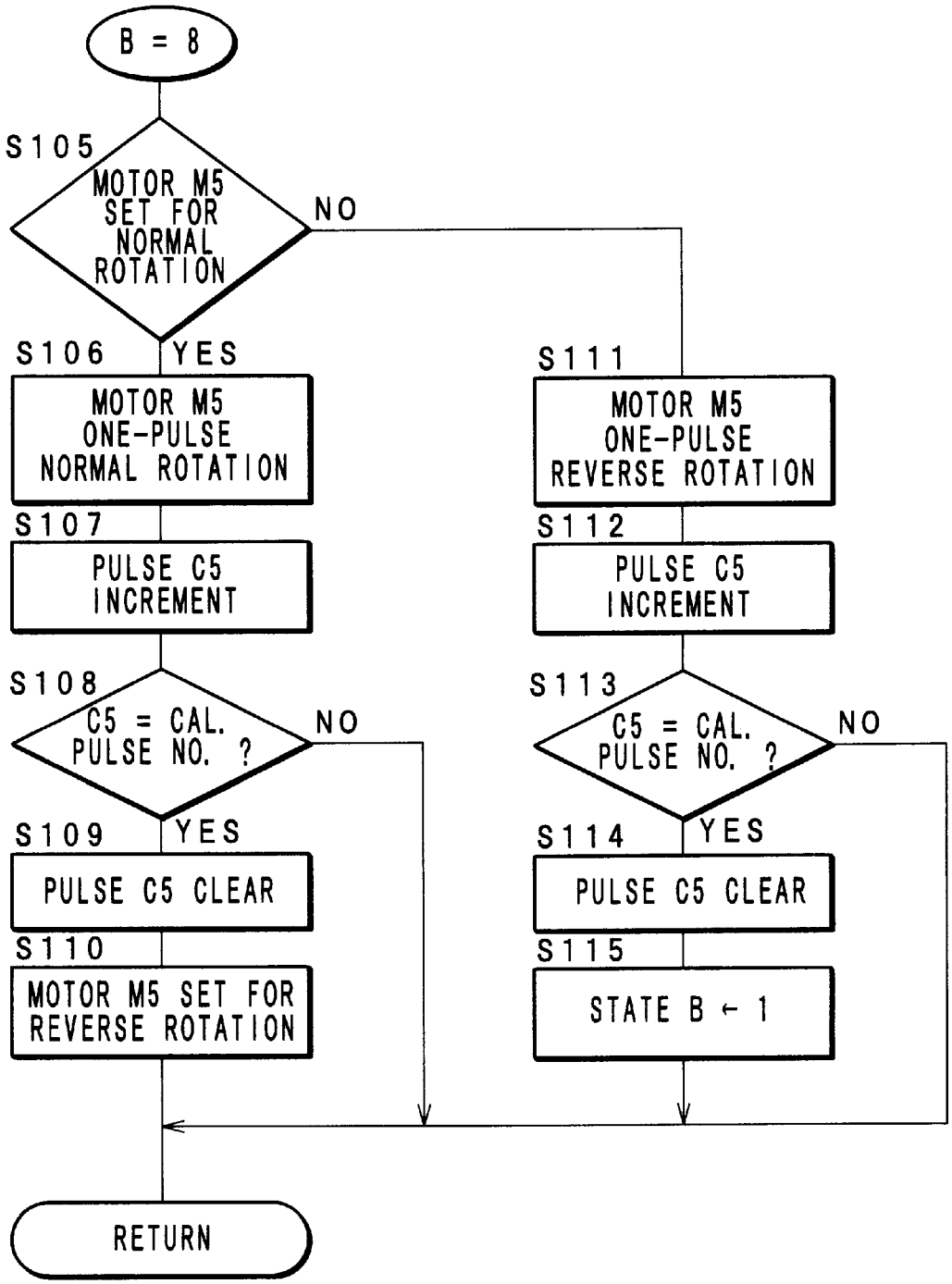
Figure 33:
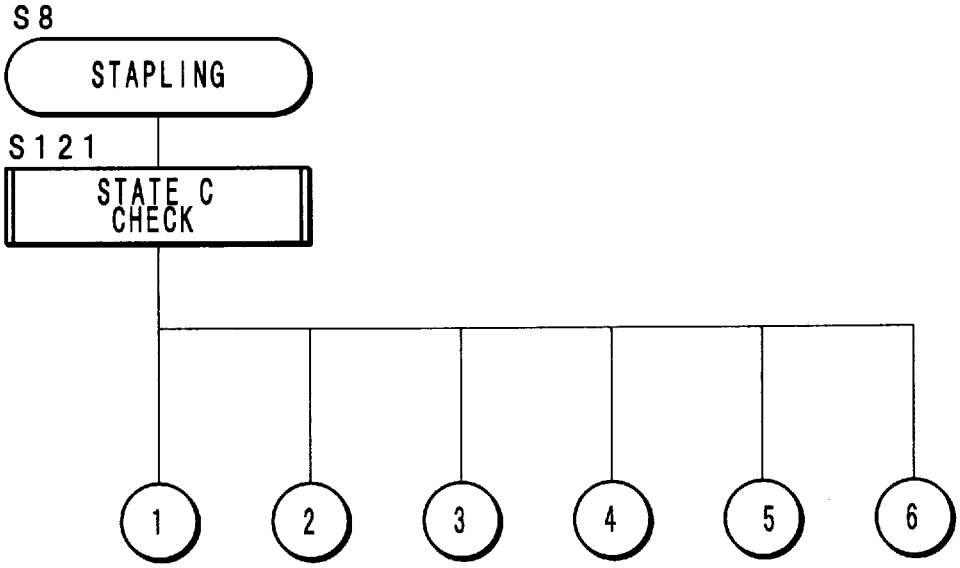
FIGS. 33, 34, 35, 36, 37, 38 and 39 are flowcharts showing stapling.
Figure 34:
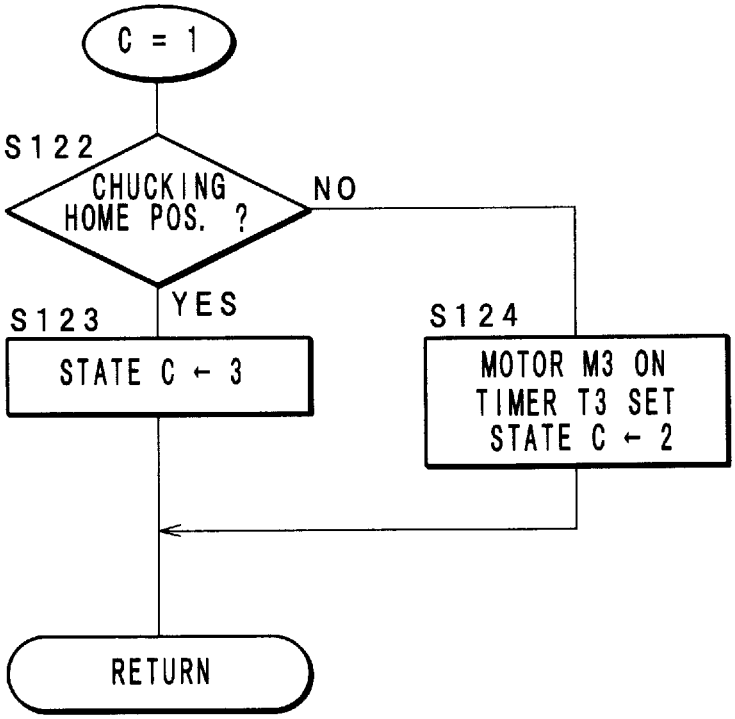
Figure 35:
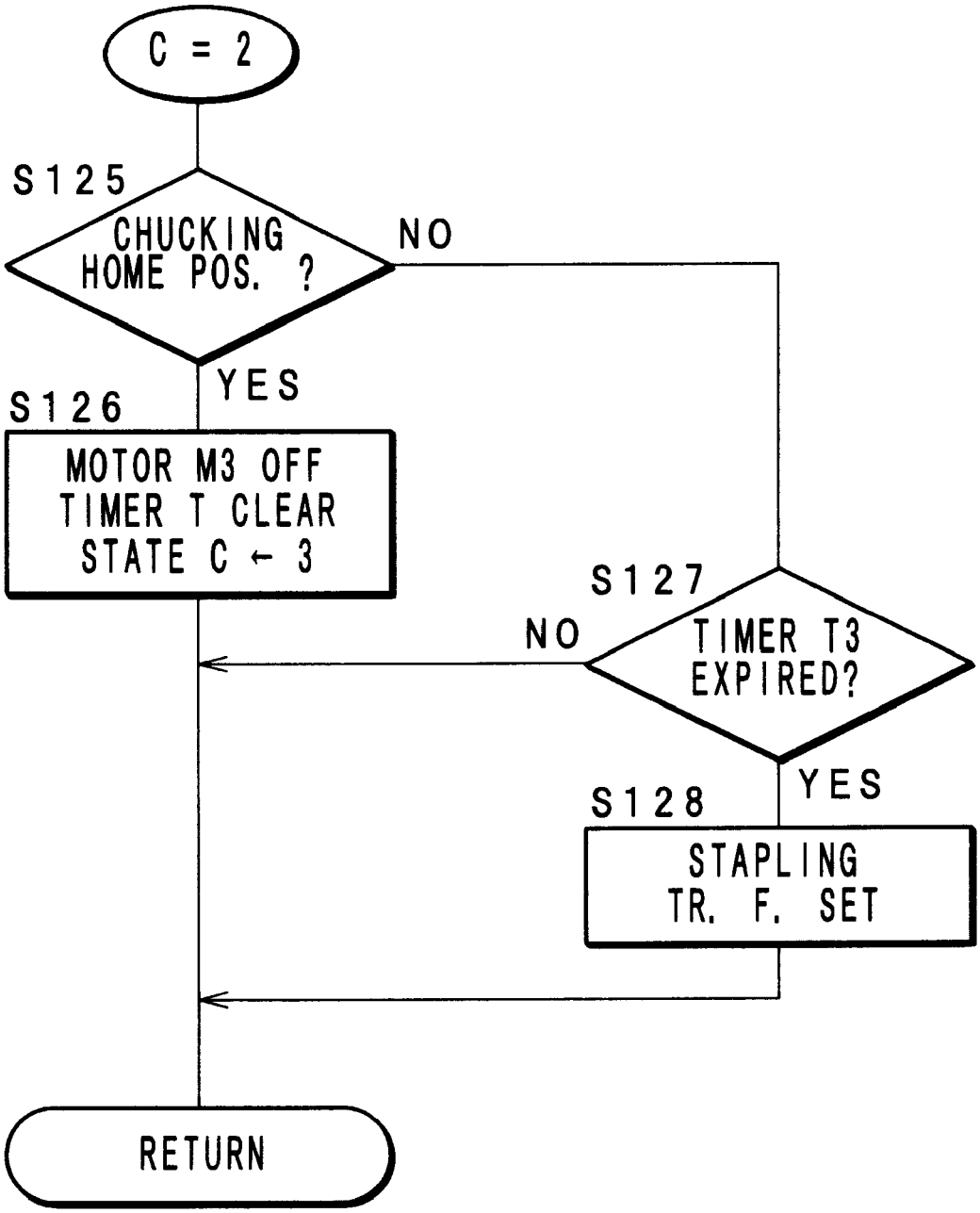
Figure 36:
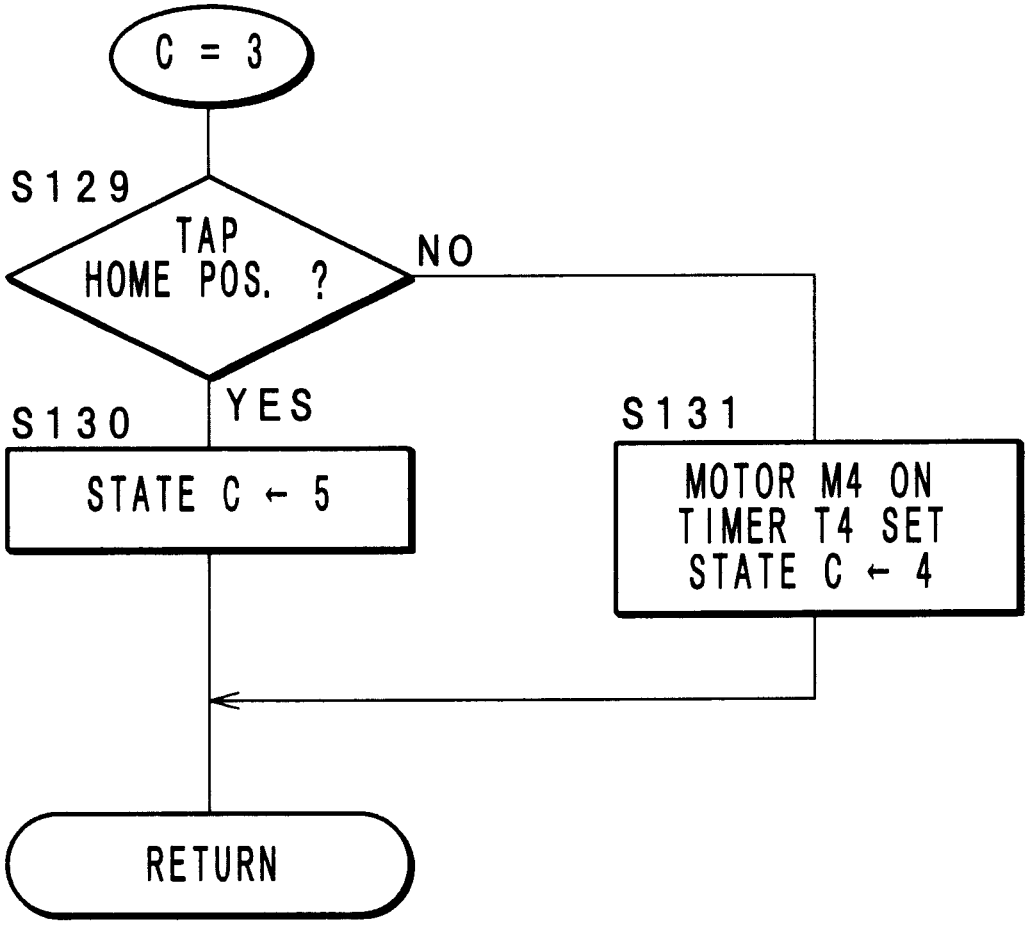
Figure 37:
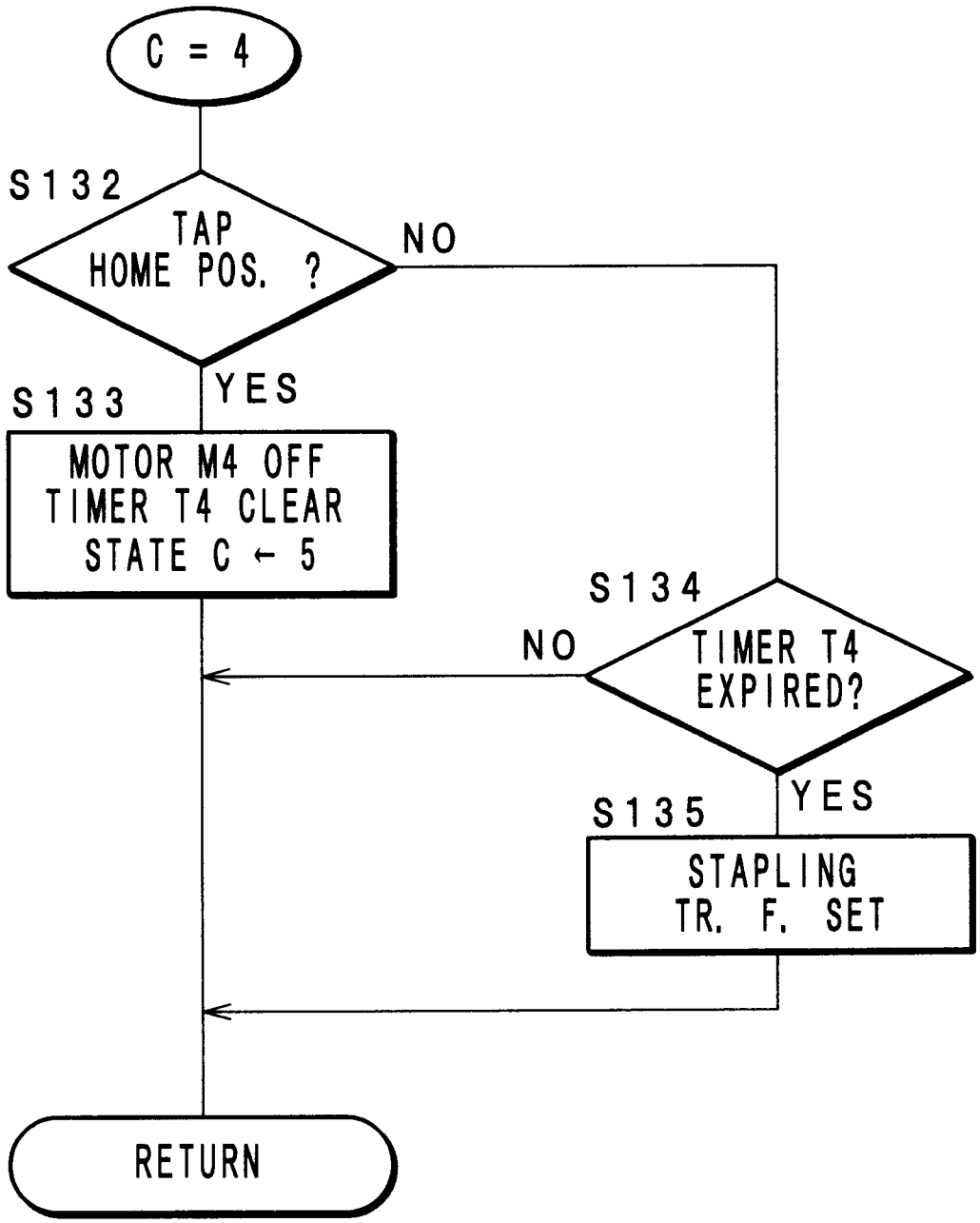
Figure 38:
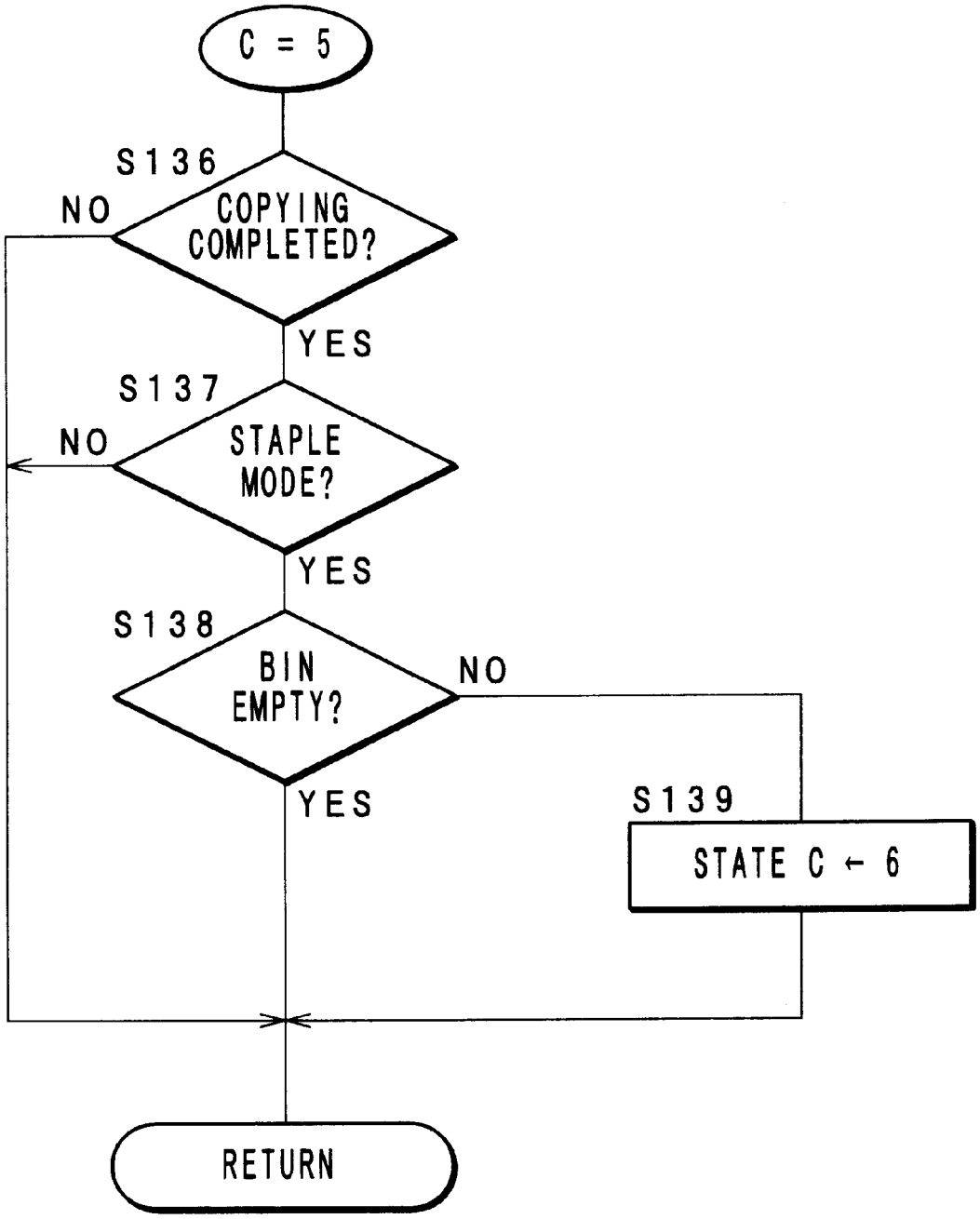
Figure 39:
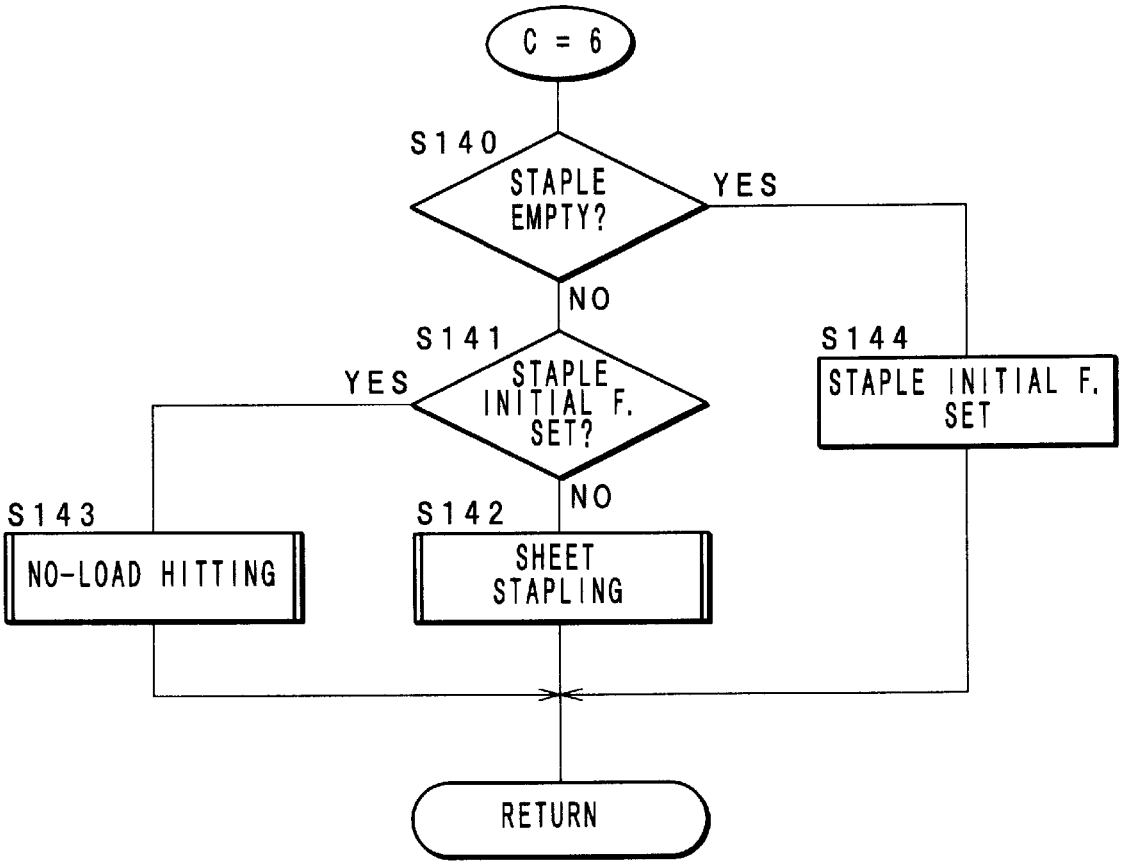

FIG. 14 shows a subroutine for mode checking which is carried out at step S5. In this subroutine, the bin moving direction and sort starting bin 12 are determined according to a copy mode set by an operator.

First, whether a print key 123 is turned on or not is judged at step S500. If the print key 123 is turned on, steps from step S504 are processed. If the print key 123 is not turned on, whether another key is turned on or not is judged at step S501. If another key is turned on, a timer M which counts a specified stand-by time is set at step S502. The timer M is renewed at every key inputting. With confirming expiration of the timer M at step S503, steps from step S504 are processed.

Whether the sort mode is set or not is judged at step S504. When the sort mode is not set, that explains that the non-sort mode or the group mode is set, and the start bin counter C0 is set to "1" at step S505. Thereby, the first bin $\mathbf{12}_{(1)}$ is set at the sheet hand-out position A. When the sort mode is set, a number of bin moving direction change is calculated at step S506.

The number of switching the direction of movement of the bins is calculated based on the number of originals, the original mode (simplex or duplex), the copy mode (simplex, duplex, 2 in 1, duplex 2 in 1 or book division), the registered number (the number of copy sets to be made) and the staple mode. First, the number of sheets which will be discharged from the copying machine 1 in the selected copy mode is calculated. The calculation in each mode is described below.

simplex original/simplex copy mode:
the number of sheets=the number of originals×the registered number simplex original/duplex copy mode:
the number of sheets=(the number of originals÷2) (raise)×the registered number simplex original/2 in 1 copy mode:
the number of sheets=(the number of originals÷2) (raise)×the registered number simplex original/duplex 2 in 1 copy mode:
the number of sheets=(the number of originals÷4) (raise)×the registered number simplex original/book division copy mode:
the number of sheets=the number of originals×2×the registered number duplex original/simplex copy mode:
the number of sheets=the number of originals×2×the registered number duplex original/duplex copy mode:
the number of sheets=the number of originals×the registered number duplex original/2 in 1 copy mode:
the number of sheets=the number of originals×the registered number duplex original/duplex 2 in 1 copy mode:
the number of sheets=(the number of originals÷2) (raise)×the registered number duplex original/book division copy mode:
the number of sheets=the number of originals×2×2×the registered number As is apparent from the above expressions, the number of copy sheets to be discharged from the copying machine 1 in the mode depends on the number of originals which are reproduced on a sheet and the registered number. In the above expressions, the term "raise" means raising the decimals to a unit.

For example, when duplex copies are made from simplex originals, the images of two originals are copied on one sheet. Accordingly, if the number of originals is an even number, the number of sheets discharged from the copying machine 1 is a half of the number, and if the number of originals is an odd number, the number of sheets discharged from the copying machine 1 is the quotient of the division plus one. When duplex 2 in 1 copies are made from simplex originals, the images of four originals are copied on one sheet. Accordingly, if the number of original is a multiple of four, the number of sheets discharged from the copying machine 1 is one fourth of the number. If the number of originals is not a multiple of four, the number of sheets discharged from the copying machine 1 is the quotient of the division plus one.

When simplex copies are made from duplex originals, the number of sheets discharged from the copying machine 1 is double the number of originals. When 2 in 1 copies are made from simplex originals, the images of two originals are copied on one sheet. Accordingly, if the number of originals is an even number, the number of sheets discharged from the copying machine 1 is a half of the number. If the number of originals is an odd number, the number of sheets discharged from the copying machine 1 is the quotient of the division plus one. Further, when book division copies are made from duplex originals, four sheets are used to copy one original. Accordingly, the number of sheets discharged from the copying machine 1 is four times the number of originals.

The above description is about the relationship between the number of sheets to be discharged from the copying machine 1 and the number of originals; however, in a system which judges whether there are images on originals to be copied and determines whether copying is to be executed based on the judgment, the number of sheets to be discharged from the copying machine 1 depends on the number of images on the originals. For example, when the images of a mixed set of simplex originals and duplex originals are to be copied, the number of sheets to be discharged from the copying machine 1 depends on the number of images.

The number of times of switching the direction of movement of the bins depends on the number of sheets discharged from the copying machine 1, the registered number and whether the copy sets are to be stapled. When unstapled copy sets are to be made, the times of switching the direction of movement is calculated by dividing the number of sheets discharged from the copying machine 1 by the registered number. When stapled copy sets are to be made, the times of switching the direction of movement further depends on the way of stapling. For example, in a one-point staple mode, the number of switching the direction of movement is that in the case of making unstapled copy sets plus one. In a two-point staple mode, the number of switching the direction of movement is that in the case of making unstapled copy sets plus two. Here, in the two-point staple mode, after stapling of all the copy sets at one point, stapling of the copy sets at another point is executed. If the two-point staple mode is to make a one-pitch movement of the bins after stapling of a copy set at two points, the number of times of switching the direction of movement is that in the case of making unstapled copy sets plus one.

More specifically, when unstapled copy sets are made (only sorting is executed), the number of times of switching the direction of movement of the bins in each mode is as follows. When stapled copy sets are made, the number of times of switching the direction of movement of the bins in each mode is that in the case of making unstapled copy sets plus one or two.

simplex original/duplex copy mode:
the number of switching the direction of movement=the number of originals simplex original/duplex copy mode:
the number of switching the direction of movement=the number of originals÷2 (raise)

simplex original/2 in 1 copy mode:
the number of switching the direction of movement=the number of originals÷2 (raise)

simplex original/duplex 2 in 1 copy mode:
the number of switching the direction of movement=the number of originals÷4 (raise)

simplex original/book division copy mode:
the number of switching the direction of movement=the number of originals×2 duplex original/simplex copy mode:
the number of switching the direction of movement=the number of originals×2 duplex original/duplex copy mode:
the number of switching the direction of movement=the number of originals duplex original/duplex 2 in 1 copy mode:
the number of switching the direction of movement=the number of originals 2 (raise)

duplex original/book division copy mode:
the number of switching the direction of movement=the number of originals×2×2

The number of switching the direction of movement of the bins in the sort mode is generally calculated by using the following expression:

the number of switching the direction of movement=the number of originals$\times N_D \times N_P + N_S$ wherein $N_D$=1 in the simplex original mode, $N_D$=2 in the duplex original mode, $N_P$=1 in the simplex copy mode, $N_P$=½ in the duplex copy mode, $N_P$=1/2 in the simplex 2 in 1 mode, $N_P$=¼ in the duplex 2 in 1 mode, $N_P$=2 in the book division mode, $N_S$=0 in the non-staple mode, $N_S$=1 in the one-point staple mode and $N_S$=2 in the two-point staple mode.

In an image forming system which cannot handle duplex originals, $N_D$=1. In an image forming system which cannot make duplex copies, $N_P$=1 in the ordinary copy mode, and $N_P$=½ in the 2 in 1 mode. In a sorter without a stapling function, any mode is judged to be the non-staple mode, and $N_S$=0 at all times. Needless to say, when one copy set is made, the direction of movement of the bins is not switched.

Next, whether the number of times of switching the direction of movement of the bins is an even number or not is judged at step S507. If the number is even, the start bin counter C0 is set to "1" at step S508. If the number is odd, the start bin counter C0 is set to a registered number (a number of copy) at step S509. When the number is odd, since the bin assembly 10 is stopped upward after stapling is finished, sorting is carried out starting from a bin 12 which is equivalent to the registered number.

FIGS. 15 through 23 show a subroutine for bin moving which is carried out at step S6. In this subroutine, first, the bin assembly 10 is set at a sort starting position for sorting processing, and then, moved upward or downward step by step.

The state counter A is checked at step S600, and following processing is carried out according to the counter value. The counter value of the state counter A is "0" through "7", and reset to "0" right after the power supply is turned on.

When the state counter A is "0", the bin assembly 10 is set at the lower limit position (home position). First, whether the bin assembly 10 is set at the lower limit position according to on and off of the sensor SE1 is judged at step S601. When the bin assembly 10 is not set at the lower limit position, the bin assembly 10 is moved downward by rotating the bin moving motor M2 in the reverse direction at step S603. When the bin assembly 10 is set at the lower limit position, the motor M2 is stopped at step S602, and the start bin counter C0 and present bin counter C1 are set to "1", and the state counter S is set to "1".

The start bin counter C0 is, as shown in steps S508 and S509, a counter which shows bins $\mathbf{12}_{(20)}$ through $\mathbf{12}_{(20)}$ for sheets to be received. The present bin counter C1 is a counter which shows a bin among the bins $\mathbf{12}_{(1)}$ through $\mathbf{12}_{(20)}$ which is set at the sheet hand-out position A at each processing.

When the state counter A is "1", the start bin 12 which the first sheet is ejected to is moved to the sheet hand-out position A. First, values of the counters C0 and C1 are compared at step S604, and whether the start bin 12 is set at the sheet hand-out position A is judged. If C1=C0, steps from step S605 are processed. If it is not C1=C0, whether C1<C0 is judged at step S614. If C1<C0, that is, when the start bin 12 is located lower than the sheet hand-out position A, the bin assembly 10 is moved upward by rotating the motor M2 in the normal direction at step S615. Then, with confirming at step S616 that the bins 12 are set at the fixed position by the sensor SE2, the present bin counter C1 gains an increment at step S617. If it is not C1<C0 (NO at step S614), that is, when the start bin 12 is located lower than the sheet hand-out position A, the bin assembly 10 is moved downward by rotating the motor M2 in the reverse direction at step S618. Then, with confirming at step S619 that the bins 12 are set at the fixed position by the sensor SE2, the present bin counter C1 gains a decrement at step S620.

On the other hand, if C1=C0 (YES at step S604), the motor M2 is stopped at step S605. Next, with confirming at step S606 that the copying operation is started, whether the start bin counter C0 is "1" is judged at step S607, that is, whether sorting is started from the first bin $12_{(1)}$ is judged. If C0=1, whether the sort mode is set is judged at step S608. When the sort mode is set, the state counter A is set to "2" at step S609. When the sort mode is not set, the state counter A is set to "6" at step S610. If it is not C0=1 (NO at step S607), whether the sort mode is set is judged at step S611. When the sort mode is set, the state counter A is set to "3" at step S612. When the sort mode is not set, the state counter A is set to "7" at step S613.

When the state counter A is "2", the sorting operation is carried out while the bin assembly 10 is inoved upward. First, whether the bins 12 are moving upward according to the rotating direction of the bin moving motor M2 at step S621. If the bins 12 are moving upward, with confirming at step S622 that the bin 12 is set at the fixed position by the sensor SE2, the motor M2 is stopped a step S623, and the present bin counter C1 gains an increment. The bin assembly 10 is stopped at the sort start position right after the sorter 4 is driven, thus, it is judged "NO" at step S621 and the processing goes to step S624. After the first sheet handing-out, steps S621 through S623 are carried out, and the processing goes to step S624.

With confirming the completion of sheet handing-out at step S624, a value of the present bin counter C1 and a registered value are compared at step S625. If it is not C1=registered number, at step S631, the bin moving motor M2 is rotated in the normal direction to move the bin assembly 10 upward to be ready for next sheet handing-out. If it is C1=registerd number, whether all copy processing is finished is judged at S626. When the copying processing is not finished, the state counter A is set to "3" at step S630. When the copying processing is finished, whether the staple mode is set is judged at step S627. When the stapling is not carried out, a value of the present bin counter C1 is set at the start bin counter C0 at step S628, and the state counter A is set to "1". When the stapling (2-point stapling) is carried out, the motor M2 is rotated in the normal direction at step S629, and the state counter A is set to "5", and then, the processing goes to the stapling. The reason to move the bin assembly 10 at this point is that, since the stapling level $B_1$ is located upward than the sheet hand-out position A by one bin, in order to staple sheets on the lowermost bin 12 which receives the last sheet, the bin assembly 10 has to move upward by one bin.

When the state counter A is "3", the sorting is carried out while moving the bin assembly 10 downward. First, whether the bins 12 are moving downward according to the rotating direction of the bin moving motor M2 is judged at step S641. When the bins 12 are moving downward, with confirming that the bins 12 are set at the fixed position by the sensor SE2 at step S642, the motor M2 is stopped at step S643, and the present bin counter C1 gains a decrement. The bin assembly 10 is stopped at the sort start position right after the sorter 4 is driven, accordingly, it is judged "NO" at step S641 and the processing goes to step S644. After the first sheet handing-out is completed, steps S641 through S643 are processed, and then, the processing goes to step S644.

With confirming the completion of sheet handing-out at step S644, whether the present bin counter C1 is "1" is judged at step S645. If it is not C1=1, the bin moving motor M2 is rotated in the reverse direction at step S651 to move the bin assembly 10 downward, and ready to next sheet-handing out. If C1=1, whether all copy processing is finished is judged at step S646. When the copy processing is not finished, the state counter A is set to "2" at step S650. When the all copy processing is finished, whether the staple mode is set is judged at step S647. When the stapling is not carried out, a value of the bin counter C1 is set to the start bin counter C0 at step S648, and the state counter A is set to "1". When the stapling (1-point stapling) is carried out, the motor M2 is rotated in the normal direction at step S649, and the state counter A is set to "4", and the processing goes to stapling. The reason to move the bin assembly 10 upward is, since the stapling level $B_1$ is located upward than the sheet hand-out position A by one bin, in order to staple sheets on the lowermost bin $12_{(1)}$ which receives the last sheet, the bin assembly 10 has to move upward by one bin.

When the state counter A is "4", in order to staple from the first bin $12_{(1)}$, the bin assembly 10 is moved upward. First, whether the bins 12 are moving upward according to the rotating direction of the motor M2 is judged at step S661. When the bins 12 are moving upward, with confirming that the bins 12 are set at the fixed position by the sensor SE2 at step S662, the motor M2 is stopped at step S663, and the present bin counter C1 gains an increment.

Next, with confirming at step S664 that stapling of a set of sheets is completed, a value of the present bin counter C1 and a value that 1 is added to the registered number are compared. If it is not C1=registered number+1, the motor M2 is rotated in the normal direction at step S667, and these processing starting from step S661 is repeated again. If C1=registered number+1, the stapling for all sheets are finished. Accordingly, at step S666, a value of the present bin counter C1 is set to the start bin counter C0, and the state counter A is set to "1".

When the state counter A is "5", the bin assembly 10 is moved upward by one step in order to start stapling from the lowermost bin among the bins 12 which receives sheets, and then moved down. First, whether the bins 12 are moving upward according to the rotating direction of the bin moving motor M2 is judged at step S671. When the bins 12 are moving upward, with confirming that the bins 12 are set at the fixed position by sensor SE2 at step S672, the motor M2 is stopped at step S673, and the present bin counter C1 gains an increment.

Next, whether the bins 12 are moving downward is judged at step S674. When the bins 12 are moving downward (the bins 12 are moved downward in following step S682), with confirming that the bins 12 are set at the fixed position at step S675, the motor M2 is stopped at step S676, and the present bin counter C1 gains a decrement. Further, with confirming at step S677 that the stapling of a set of sheets is completed, whether a value of the present bin counter C1 becomes "2" is judged at step S678. If it is not C1=2, the motor M2 is rotated in the reverse direction at step S682, and this steps S674 through S676 are repeated. If C1=2, whether the stapling of all sheets is finished is judged at step S679. When the stapling is finished, a value of the present bin counter C1 is set to the start bin counter C0 at step S580, and the state counter A is set to "1". When the stapling is not finished, that is, processing for 2-point stapling is left, the state counter A is set to "4" at step S681.

When the state counter A is "6", the grouping operation is carried out while moving the bin assembly 10 upward. First, whether the bins 12 are moving upward according to the rotating direction of the bin moving motor M2 is judged at step S691. When the bins 12 are moving upward, with confirming that the bins 12 are set at the fixed position by the sensor SE2 at step S692, the motor M2 is stopped at step S693, and the present bin counter C1 is incremented. Right after the sorter 4 is driven, the bin assembly 10 is stopped at the grouping start position, and it is judged "NO" at step S691 and the processing goes to step S694. After the first sheet handing-out, steps S691 through S693 are processed, and the processing goes to step S694.

Whether the group mode is set is judged at step S694. When the group mode is not set, that is, the non-sort mode is set, whether the bin 12 is full is judged at S701. When the bin 12 is full, the motor M2 is moved in the normal direction to move the bins 12 upward by one step to be ready for handing-out sheets to the lower bin 12 at step S700. When the bin 12 is not full, with confirming at step S702 that all copy processing is finished, a value of the present bin counter C1 is set to the start bin counter C0 at step S703, and the state counter A is set to "1".

When the group mode is set, with confirming at step S695 that the handing-out of registered number of sheets is completed, whether all copy processing is finished is judged at step S696. When the copy processing is not finished, the motor M2 is rotated in the normal direction at step S700 to move the bins 12 upward by one step to be ready for handing-out next registered number of sheets to the lower bin 12. When the copy processing is finished, whether the staple mode is set is judged at step S697. When the staple mode is not set, a value of the present bin counter C1 is set to the start bin counter C0 at step S698 and the state counter A is set to "1". When the stapling (2-point stapling) is carried out, the motor M2 is rotated in the normal direction at step S699, and the state counter A is set to "5", and the processing goes to stapling. The reason to move the bin assembly 10 upward is that, since the stapling level $B_1$ is located upward than the sheet hand-out position A by one bin, in order to staple sheets on the lowermost bin 12 which receives the last sheet, the bin assembly 10 has to be moved upward by one bin.

When the state counter A is "7", the grouping operation is carried out while the bin assembly 10 is moved downward. First, whether the bins 12 are moving downward according to the rotating direction of the bin moving motor M2 is judged at step S711. When the bins 12 are moving downward, with confirming at step S712 that the bins 12 are set at the fixed position by the sensor SE2, the motor M2 is stopped at step S713, and the present bin counter C1 gains a decrement. Right after the sorter 4 is driven, the bin assembly 10 is stopped at the grouping start position, and it is judged "NO" at step S711 and the processing goes to step S714. After the first sheet handing-out, steps S711 through S713 are processed, and the processing goes to step S714.

Whether the group mode is set is judged at step S714. When the group mode is not set, that is, the non-sort mode is set, whether the bin 12 is full is judged at step S721. If the bin 12 is full, the motor M2 is rotated in the reverse direction to move the bins 12 downward by one step to be ready for handing-out sheets to upper bin 12 at step S720. If the bin 12 is not full, with confirming at step S722 that all copy processing is finished, a value of the present bin counter C1 is set to the start bin counter C0 at step S723, and the state counter A is set to "1".

When the group mode is set, with confirming at step S715 that the handing-out of a registered number of sheets is completed, whether all copy processing is finished is judged at step S716. When the copy processing is not finished, the motor M2 is rotated in the reverse direction to move the bins 12 downward by one step at step S720 and ready for handing-out next registered number of sheets to the upper bin 12. When the copy processing is finished, whether the staple mode is set is judged at step S717. When the staple mode is not set, a value of the present bin counter C1 is set to the start bin counter C0 at step S718, and the state counter A is set to "1". When the stapling (2-point stapling) is carried out, the motor M2 is rotated in the normal direction at step S719, and the state counter A is set to "4", and the processing goes to stapling. The reason to move the bin assembly 10 upward is that, since the stapling level $B_1$ is located upward than the sheet hand-out position A by one bin, in order to staple sheets on the first bin $\mathbf{12}_{(1)}$ which receives the last sheet, the bin assembly 10 has to be moved upward by one bin.

FIGS. 24 through 32 show a subroutine for sheet aligning which is carried out at step S7. This subroutine is to align sheets in each bin by moving the aligning rod 41 every time a sheet is handed into a bin and after stapling operation is completed.

First, a state counter B is checked at step S71, and the processing thereafter depends on the counter value. The state counter B is set to "1" when the sort mode is selected.

When the state counter B is "1", at step S72 it is judged from the on/off state of the sensor SE6 whether the aligning rod 41 is in the home position. If the aligning rod 41 is in the home position, the state counter B is set to "3" at step S73. If not, at step S74, the aligning motor M5 is rotated in reverse to move the aligning rod 41 to the rear, the aligning trouble timer $T_2$ is set, and the state counter B is set to "2".

When the state counter B is "2", at step S75 it is judged from the on/off state of the sensor SE6 whether the aligning rod 41 has reached the home position. When the arrival of the aligning rod 41 in the home position is judged, at step S76, the aligning motor M5 is stopped, the trouble timer $T_2$ is cleared, and the state counter B is set to "3". However, if it is judged at step S77 that the aligning trouble timer $T_2$ expires before the aligning rod 41 reaches the home position, at step S78, the tray trouble flag is set to inhibit copying operation of the machine 1.

When the state counter B is "3", at step S79 it is judged from the on/off state of the sensor SE5 whether a sheet has been handed into the bin 12 in the sheet hand-out position A. When the completion of the sheet handing-out is judged, the state counter B is set to "4" at step S80.

When the state counter B is "4", at step S81 it is judged from the on/off state of the sensor SE2 whether the bins 12 have been moved one step up or down. When the completion of the bin movement is judged, at step S82 the number of driving pulses of the aligning motor M5 to move the aligning rod 41 to the aligning position is calculated from the sheet size. Then, the motor M5 is set for rotation in the normal direction at step S83, and the state counter B is set to "5".

When the state counter B is "5", the aligning motor M5 is checked at step S85 whether to be set for normal rotation. If the motor M5 is set for normal rotation, the motor M5 is rotated by one pulse at step S86, and a pulse counter C5 gains an increment at step S87. Then, the processing stays at step S88 until the value of the pulse counter C5 becomes equal to the pulse number calculated at step S82. In the meantime, the aligning rod 41 comes to the front from the home position. When the pulse counter value C5 becomes equal to the calculated pulse number, which means that the aligning rod 41 has reached the aligning position, at step S89, the pulse counter C5 is cleared, and the aligning motor M5 is set for reverse rotation.

When the aligning motor M5 is set for reverse rotation ("NO" at step S85), the motor M5 is rotated by one pulse at step S91, and the pulse counter C5 gains an increment at step S92. Then, the processing stays at step S93 until the pulse counter value C5 becomes equal to the calculated pulse number. In the meantime, the aligning rod 41 moves to the rear from the aligning position. When the pulse counter value C5 becomes equal to the calculated pulse number, which means that the aligning rod 41 has returned to the home position, at step S94, the pulse counter C5 is cleared, and the state counter B is set to "6".

When the state counter B is "6", it is judged at step S96 whether the copying operation is completed. If the copying operation is not completed, the state counter B is set to "3" at step S100 to continue the sheet aligning operation. If the copying operation is completed, it is judged at step S97 whether the staple mode is selected. If the staple mode is not selected, the state counter B is set to "1" at step S99. If the staple mode is selected, the state counter B is set to "7" at step S98. The steps thereafter are to align stapled sheets in each bin 12.

When the state counter B is "7", it is judged at step S101 whether the stapling operation is completed. On confirmation of the completion of the stapling operation, the number of driving pulses of the aligning motor M5 is calculated from the sheet size at step S107. Then, the motor M5 is set for normal rotation at step S103, and the state counter B is set to "8" at step S104.

When the state counter is "8", the aligning motor M5 is checked at step S105 whether to be set for normal rotation. If the motor M5 is set for normal rotation, the motor M5 is rotated by one pulse at step S106, and the pulse counter C5 gains an increment at step S107. Then, the processing stays at step S108 until the pulse counter value C5 becomes equal to the pulse number calculated at step S102. In the meantime, the aligning rod 41 moves to the front from the home position in order to align the stapled sets of sheets. When the counter value C5 becomes equal to the calculated number, the pulse counter C5 is cleared at step S109, and the aligning motor M5 is set for reverse rotation at step S110.

"When the aligning motor M5 is set for reverse rotation ("NO" at step S105), the motor M5 is rotated by one pulse at step S111, and the pulse counter C5 gains an increment at step S112. Then, the processing stays at step S113 until the pulse counter value C5 becomes equal to the calculated pulse number. In the meantime, the aligning rod 41 moves to the rear from the aligning position. When the counter value C5 becomes equal to the calculated pulse number, which means that the aligning rod 41 has returned to the home position, the pulse counter C5 is cleared at step S114, and the state counter B is set to "1" at step S115.

FIGS. 33 through 39 show a subroutine for stapling which is carried out at step S8. In the subroutine, the chucking 90 and the stapler 100 are checked whether to be in the respective home positions, and the presence of staples in the stapler 100 is checked. When all the conditions are met, the stapling is carried out.

First, a state counter C is checked at step S121, and the processing thereafter depends on the counter value. The state counter C is set to "1" when the staple mode is selected.

When the state counter C is "1", at step S122 it is judged from the on/off state of the sensors SE7 and SE8 whether the chucking 90 is in the home position. If the chucking 90 is in the home position, the state counter C is set to "3" at step S123. If not, at step S124, the chucking motor M3 is turned on, a chucking trouble timer $T_3$ is set, and the state counter C is set to "2".

When the state counter C is "2", at step S125 it is judged from the on/off state of the sensors SE7 and SE8 whether the chucking 90 has reached the home position. On confirmation of the arrival of the chucking 90 in the home position, at step S126, the chucking motor M3 is turned off, the chucking trouble timer T3 is cleaned, and the state counter C is set to "3". However, if the chucking trouble timer T3 expires before the chucking 90 reaches the home position, the stapling trouble flag is set at step S128 to inhibit stapling operation.

When the state counter C is "3", at step S129 it is judged from the on/off state of the sensor SE10 whether the tap of the stapler 100 is in the home position. If the tap of the stapler 100 is in the home position, the state counter C is set to "5" at step S130. If not, at step S131, the stapler motor M4 is turned on, a stapling trouble timer $T_4$ is set, and the state counter C is set to "4".

When the state counter C is "4", at step S132 it is judged from the on/off state of the sensor SE10 whether the tap of the stapler 100 has reached the home position. On confirmation of the arrival of the tap in the home position, at step S133, the stapler motor M4 is turned off, the stapling trouble timer T4 is cleared, and the state counter C is set to "5". However, if the stapling trouble timer T4 expires before the tap reaches the home position, the stapling trouble flag is set at step S135 to inhibit stapling operation.

When the state counter C is "5", the completion of copying operation is checked at step S136, and selection of the staple mode is checked at step S137. If the completion of copying operation and the selection of the staple mode are confirmed at the respective steps S136 and S137, at step S138 it is judged from the on/off state of the sensor SE3 whether there are sheets in the bins 12. If there are no sheets, the processing returns to the main routine, and if there are any sheets, the state counter C is set to "6" at step S139.

When the state counter C is "6", at step S140 it is judged from the on/off state of the sensor SE11 whether there are any staples left in the stapler 100. If there are no staples, a staple initial flag is set at step S144. Although it is not shown in the flowchart of FIG. 39, the setting of the staple initial flag is indicated on the operation panel 120. Thereby, the operator is informed of the necessity of loading staples and exchanges cartridges through the small door 36 of the sorter 4.

If there are any staples ("NO" at step S140), the staple initial flag is checked at step S141. If the staple initial flag is not set, sheet stapling together with bin moving is carried out at step S142. If the staple initial flag is set, which means that a new staple cartridge has been loaded, noload hitting is carried out at step S143. Although this no-load hitting is not shown in the flowchart, when a brand-new cartridge is used, several times of no-load hitting is necessary till staples are carried to the stapling position.

Figure 40:
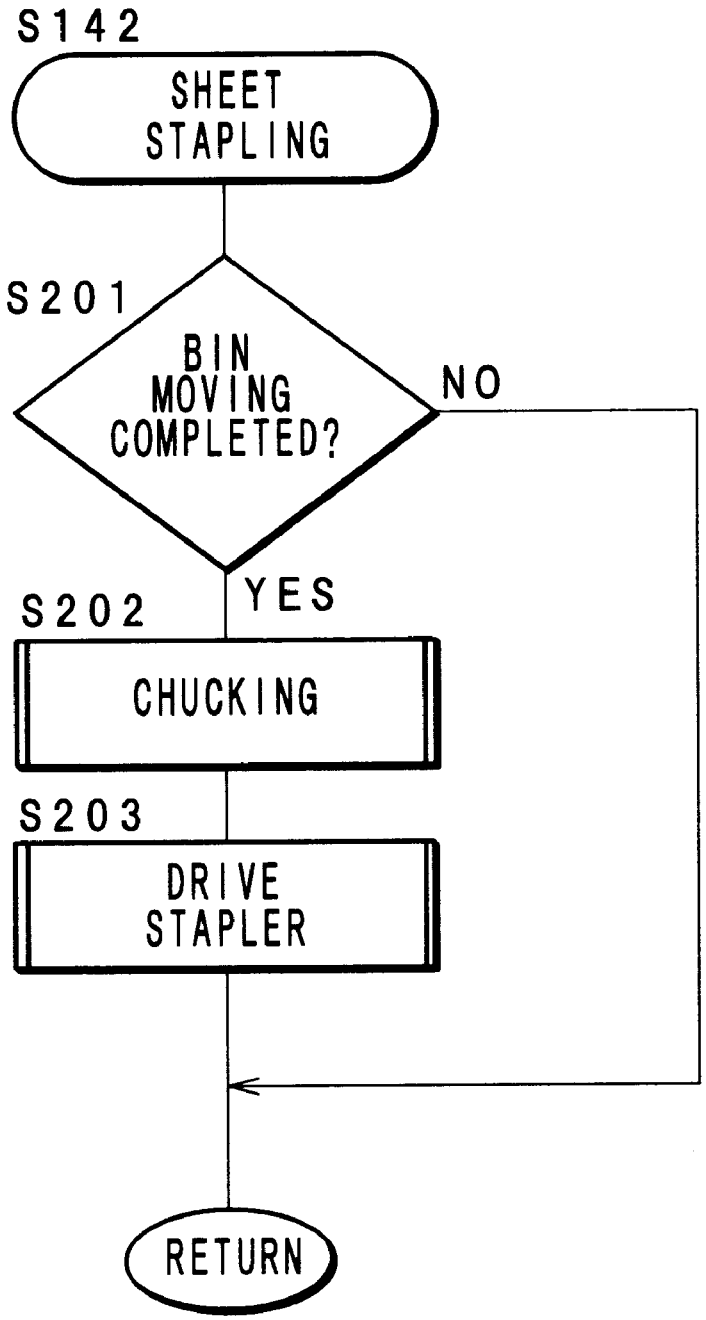
FIG. 40 is a flowchart showing a subroutine for sheet stapling together with bin moving.

FIG. 40 shows a subroutine for sheet stapling together with bin moving which are carried out at step S142.

In this subroutine, on confirmation of the completion of moving the bin 12 at step S201, the chucking 90 grabs sheets stored on the bin 12 which is set at the staple processing position $B_1$ at step S202, and moves them to the stapling position $B_2$. Then at step S203, the stapler 100 is driven to staple sheets.

In the meanwhile, as for a sorter, a stapling function or a punching function are not always necessary. Also, an image forming machine can be, not only a copying machine, but also a laser printer which outputs image information as a hard copy.

Although the present invention has been described in connection with the preferred embodiments above, it is to be noted that various changes and modifications are apparent to a person skilled in the art. Such changes and modifications are to be understood as being within the scope of the present invention.

What is claimed is:

1. An image forming system comprising:

an image forming apparatus which forms images on sheets and discharges the sheets therefrom one by one;

a sorter which has a bin assembly comprising a plurality of bins which are movable up and down, the sorter distributing the sheets discharged from the image forming apparatus among the bins while moving up and down the bin assembly interval by interval; and a controller which calculates the number of times of switching the direction of movement of the bin assembly based on an image forming mode and determines the bin to which a first sheet is sent and the direction in which the bin assembly is moved first.

2. An image forming system comprising:

an image forming apparatus which forms images on sheets and discharges the sheets therefrom one by one;

a plurality of bins which are movable up and down;

a bin moving mechanism which moves up and down the plurality of bins interval by interval; and a controller which determines the bin to which a first sheet is sent and the direction in which the bins are moved first, said controller calculating the number of times of switching the direction of movement of the bins based on an image forming mode and detemining the bin to which a first sheet is sent and the direction in which the bins are moved first.

3. An image forming system as claimed in claim 2, wherein the number of times of switching the direction of movement of the bins are calculated by using the following expression:

the number of times of switching the direction of movement of the bins=the number of originals$\times N_D \times N_P + N_S$ wherein $N_D$=1 in a simplex original mode, $N_D$=2 in a duplex original mode, $N_P$=1 in a simplex copy mode, $N_P$=½ in a duplex copy mode, $N_P$=½ in a simplex 2 in 1 mode, $N_P$=¼ in a duplex 2 in 1 mode, $N_P$=2 in a book division mode, $N_S$=0 in a non-staple mode, $N_S$=1 in a one-point staple mode and $N_S$=2 in a two-point staple mode.

4. An image forming system as claimed in claim 2, wherein the direction of movement of the bins is not switched when one set of copies is made.

5. An image forming system as claimed in claim 2, wherein when the number of times of switching the direction of movement of the bins is an even number, the first sheet is sent to an uppermost bin.

6. An image forming system as claimed in claim 2, wherein when the number of times of switching the direction of movement of the bins is an even number, the bins are moved up first.

7. An image forming system as claimed in claim 2, wherein when the number of times of switching the direction of movement of the bins is an odd number, the first sheet is sent to a bin which is located in a position corresponding to the number of copy sets to be made.

8. An image forming system as claimed in claim 2, wherein when the number of times of switching the direction of movement of the bins is an odd number, the bins are moved down first.

9. An image forming system as claimed in claim 2, wherein the plurality of bins are held by a holding mechanism.

10. An image forming system as claimed in claim 9, wherein the bin moving mechanism moves up and down the holding mechanism.

11. A sorter which is attached to an image forming apparatus which forms images on sheets and discharges the sheets therefrom one by one, the sorter distributing the sheets discharged from the image forming apparatus among bins, the sorter comprising;

a plurality of bins which move up and down;

a bin moving mechanism which moves up and down the plurality of bins interval by interval; and a controller which determines the bin to which a first sheet is sent and the direction in which the bins are moved first, said controller calculating the number of times of switching the direction of movement of the bins based on an image forming mode and determining the bin to which a first sheet is sent and the direction in which the bins are moved first.

12. A sorter as claimed in claim 11, wherein the number of times of switching the direction of movement of the bins are calculated by using the following expression:

the number of times of switching the direction of movement of the bins=the number of originals$\times N_D \times N_P + N_S$ wherein $N_D$=1 in a simplex original mode, $N_P$=2 in a duplex original mode, $N_P$=1 in a simplex copy mode, $N_P$=½ in a duplex copy mode, $N_P$=½ in a simplex 2 in 1 mode, $N_P$=¼ in a duplex 2 in 1 mode, $N_P$=2 in a book division mode, $N_S$=0 in a non-staple mode, $N_S$=1 in a onepoint staple mode and $N_S$=2 in a two-point staple mode.

13. A sorter as claimed in claim 11, wherein the direction of movement of the bins is not switched when one set of copies is made.

14. A sorter as claimed in claim 11, wherein when the number of times of switching the direction of movement of the bins is an even number, the first sheet is sent to an uppermost bin.

15. A sorter as claimed in claim 11, wherein when the number of times of switching the direction of movement of the bins is an even number, the bins are moved up first.

16. A sorter as claimed in claim 11, wherein when the number of times of switching the direction of movement of the bins is an odd number, the first sheet is sent to a bin which is located in a position corresponding to the number of copy sets to be made.

17. A sorter as claimed in claim 11, wherein when the number of times of switching the direction of movement of the bins is an odd number, the bins are moved down first.

18. A sorter as claimed in claim 11, wherein the plurality of bins are held by a holding mechanism.

19. A sorter as claimed in claim 18, wherein the bin moving mechanism moves up and down the holding mechanism.

20. An image forming system comprising:

an image forming apparatus which forms images on sheets and discharges the sheets therefrom one by one;

a plurality of bins which move up and down;

a bin moving mechanism which moves up and down the plurality of bins interval by interval; and a controller which is provided in order for a last sheet to be received in a bin which is located in an upper part, said controller calculating the number of times of switching the direction of movement of the bins based on an image forming mode and detemining the bin to which a first sheet is sent and the direction in which the bins are moved first.

21. An image forming system as claimed in claim 20, wherein the plurality of bins are held by a holding mechanism.

22. An image forming system as claimed in claim 21, wherein the bin moving mechanism moves up and down the holding mechanism.

23. An image forming system as claimed in claim 1, wherein the number of times of switching the direction of movement of the bin assembly is calculated based on a staple mode.

24. An image forming system as claimed in claim 2, wherein the number of times of switching the direction of movement of the bins is calculated based on a staple mode.

25. A sorter as claimed in claim 11, wherein the number of times of switching the direction of movement of the bins is calculated based on a staple mode.

* * * * *